US008282241B2

(12) United States Patent
Ramer et al.

(10) Patent No.: US 8,282,241 B2
(45) **Date of Patent: *Oct. 9, 2012**

(54) SOLID STATE LIGHTING USING LIGHT TRANSMISSIVE SOLID IN OR FORMING OPTICAL INTEGRATING VOLUME

(75) Inventors: David P. Ramer, Reston, VA (US); Jack C. Rains, Jr., Herndon, VA (US)

(73) Assignee: ABL IP Holding LLC, Conyers, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/159,150

(22) Filed: Jun. 13, 2011

(65) Prior Publication Data

US 2011/0235325 A1 Sep. 29, 2011

Related U.S. Application Data

(63) Continuation of application No. 12/127,371, filed on May 27, 2008, now Pat. No. 7,980,728.

(51) Int. Cl.
*F21V 9/16* (2006.01)

(52) U.S. Cl. ..... 362/249.02; 362/235; 362/243; 362/242; 257/98; 257/100

(58) Field of Classification Search ..... 362/227, 362/235, 236, 240, 241, 242, 243, 249.02; 313/512; 257/98, 100
See application file for complete search history.

(56) References Cited

U.S. PATENT DOCUMENTS 2,880,536 A 4/1959 Sullivan
5,608,213 A 3/1997 Pinkus et al.
5,803,592 A 9/1998 Lawson
5,877,490 A 3/1999 Ramer et al.
5,914,487 A 6/1999 Ramer et al.
6,007,225 A 12/1999 Ramer et al.
6,222,623 B1 4/2001 Wetherell
6,234,648 B1 5/2001 Borner et al.
6,286,979 B1 9/2001 Ramer et al.
6,345,903 B1 2/2002 Kolke et al.
6,357,889 B1 3/2002 Duggal et al.

(Continued)

OTHER PUBLICATIONS

International Preliminary Report on Patentability issued in International Patent Application No. PCT/US2009/044022, mailed Dec. 9, 2010.

(Continued)

*Primary Examiner* — Anabel Ton
(74) *Attorney, Agent, or Firm* — McDermott Will & Emery LLP

(57) ABSTRACT

An exemplary general lighting fixture includes an assembly forming an optical integrating volume for receiving and optically integrating light from one or more solid state light emitters and for emitting integrated light. The assembly includes a reflector having a diffusely reflective interior surface defining a substantial portion of a perimeter of the integrating volume. A light transmissive solid fills at least a substantial portion of the optical integrating volume. A light emitter interface region of the solid, for each solid state light emitter, closely conforms to the light emitting region of the respective emitter. A surface of the transmissive solid conforms closely to and is in proximity with the interior surface of the reflector. The transmissive solid also provides a light emission surface, at least a portion of which forms a transmissive optical passage for emission of integrated light, from the volume, in a direction facilitating a general lighting application.

20 Claims, 12 Drawing Sheets

U.S. PATENT DOCUMENTS

| | | | | |
|---|---|---|---|---|
| 6,361,192 | B1 | 3/2002 | Fussell et al. | |
| 6,422,718 | B1 | 7/2002 | Anderson et al. | |
| 6,437,861 | B1 | 8/2002 | Kuta | |
| 6,447,698 | B1 | 9/2002 | Ihara et al. | |
| 6,473,554 | B1 | 10/2002 | Pelka et al. | |
| 6,536,914 | B2 | 3/2003 | Hoelen et al. | |
| 6,566,824 | B2 | 5/2003 | Panagotacos et al. | |
| 6,692,136 | B2 | 2/2004 | Marshall et al. | |
| 6,700,112 | B2 | 3/2004 | Brown | |
| 6,737,681 | B2 | 5/2004 | Koda | |
| 6,828,590 | B2 | 12/2004 | Hsiung | |
| 6,836,083 | B2 | 12/2004 | Mukai | |
| 6,869,545 | B2 | 3/2005 | Peng et al. | |
| 6,872,249 | B2 | 3/2005 | Peng et al. | |
| 6,960,872 | B2 | 11/2005 | Beeson et al. | |
| 6,969,843 | B1 | 11/2005 | Beach et al. | |
| 6,985,163 | B2 | 1/2006 | Riddle et al. | |
| 6,995,355 | B2 | 2/2006 | Rains, Jr. et al. | |
| 7,025,464 | B2 | 4/2006 | Beeson et al. | |
| 7,040,774 | B2 | 5/2006 | Beeson et al. | |
| 7,102,152 | B2 | 9/2006 | Chua et al. | |
| 7,105,051 | B2 | 9/2006 | Peng et al. | |
| 7,144,131 | B2 | 12/2006 | Rains | |
| 7,148,632 | B2 | 12/2006 | Berman et al. | |
| 7,153,703 | B2 | 12/2006 | Peng et al. | |
| 7,160,525 | B1 | 1/2007 | Peng et al. | |
| 7,192,850 | B2 | 3/2007 | Chen et al. | |
| 7,220,039 | B2 | 5/2007 | Ahn et al. | |
| 7,235,190 | B1 | 6/2007 | Wilcoxon et al. | |
| 7,235,792 | B2 | 6/2007 | Elofson | |
| 7,273,904 | B2 | 9/2007 | Peng et al. | |
| 7,285,802 | B2 | 10/2007 | Ouderkirk et al. | |
| 7,350,933 | B2 | 4/2008 | Ng et al. | |
| 7,374,807 | B2 | 5/2008 | Parce et al. | |
| 7,521,728 | B2 | 4/2009 | Andrews | |
| 7,531,149 | B2 | 5/2009 | Peng et al. | |
| 7,560,677 | B2 | 7/2009 | Lyons et al. | |
| 7,625,098 | B2 | 12/2009 | Rains et al. | |
| 7,722,211 | B2 | 5/2010 | Marra et al. | |
| 7,980,728 | B2 * | 7/2011 | Ramer et al. | 362/249.02 |
| 2004/0151008 | A1 | 8/2004 | Artsyukhovich et al. | |
| 2004/0188594 | A1 | 9/2004 | Brown et al. | |
| 2006/0072314 | A1 | 4/2006 | Rains | |
| 2007/0045524 | A1 | 3/2007 | Rains, Jr. et al. | |
| 2007/0051883 | A1 | 3/2007 | Rains, Jr. et al. | |
| 2007/0138978 | A1 | 6/2007 | Rains, Jr. et al. | |
| 2007/0170454 | A1 | 7/2007 | Andrews | |
| 2008/0030974 | A1 | 2/2008 | Abu-Ageel | |
| 2008/0094835 | A1 | 4/2008 | Marra et al. | |
| 2008/0106887 | A1 | 5/2008 | Salsbury et al. | |
| 2008/0191237 | A1 | 8/2008 | Andrews | |
| 2008/0224025 | A1 | 9/2008 | Lyons et al. | |
| 2009/0003002 | A1 | 1/2009 | Sato | |
| 2009/0296368 | A1 | 12/2009 | Ramer | |

OTHER PUBLICATIONS

Pradhan, Narayan, et al., "An Alernative of CdSe Nanocrystal Emitters: Pure and Tunable Impurity Emissions in ZnSe Nonocrystals", Nov. 24, 2005, 127, pp. 17586-17587, J. A, Chem, Soc. Communications, web publication.

"ENERGY STAR Program Requirements for Solid State Lighting Luminaires Eligibility Criteria—Version 1.0", Manual, Sep. 12, 2007.

Yin, Yadong and A. Paul Alivisatos, "Colloidal nanocrystal sythesis and the organic—inorganic interface", Insight Review, Sep. 25, 2005, pp. 664-670, Nature vol. 437.

"Final Report: Highly Bright, Heavy Metal-Free, and Stable Doped Semiconductor Nanophosphors for Economical Solid State Lighting Alternatives", Report, Nov. 12, 2009, pp. 1-3, National Center for Environmental Research, web publication.

International Search Report and the Written Opinion of the International Searching Authority issued in International Patent Application No. PCT/US2009/44022 dated Jul. 2, 2009.

"Solid-State Lighting: Development of White LEDs Using Nanophosphor-InP Blends", Report, Oct. 26, 2009, pp. 1, U.S. Department of Energy—Energy Efficiency and Renewable Energy, web publication.

"Solid-State Lighting: Improved Light Extraction Efficiencies of White pc-LEDs for SSL by Using Non-Toxic, Non-Scattering, Bright, and Stable Doped ZnSe Quantum Dot Nanophosphors (Phase I)", Report, Oct. 26, 2009,pp. 1-2, U.S. Department of Energy—Energy Efficiency and Renewable Energy, web publication.

"Chemistry—All in the Dope", Editor's Choice, Dec. 9, 2005, Science, vol. 310, p. 1, AAAS, web publication.

"D-dots: Heavy Metal Free Doped Semiconductor Nanocrystals", Technical Specifications, etc. Dec. 1, 2009, pp. 1-2, NN-LABS, LLC (Nanomaterials & Nanofabrication Laboratories), CdSe/ZnS Semiconductor Nanocrystals, web publication.

Entire Prosecution of U.S. Appl. No. 12/127,371 to Ramer et al., filed on May 27, 2008, entitled "Solid State Lighting Using Light Transmissive Solid in or Forming Optical Integrating Volume".

* cited by examiner

SOLID STATE LIGHTING USING LIGHT TRANSMISSIVE SOLID IN OR FORMING OPTICAL INTEGRATING VOLUME

RELATED APPLICATIONS

This application is a Continuation of U.S. application Ser. No. 12/127,371, filed on May 27, 2008, now U.S. Pat. No. 7,980,728 the entire contents of which is hereby incorporated by reference.

TECHNICAL FIELD

The present subject matter relates to solid state type light fixtures each having an optical integrating volume filled with a solid light transmissive material, systems incorporating such light fixtures, as well as techniques for manufacturing and operating such equipment, for general lighting applications.

BACKGROUND

As costs of energy increase along with concerns about global warming due to consumption of fossil fuels to generate energy, there is an every increasing need for more efficient lighting technologies. These demands, coupled with rapid improvements in semiconductors and related manufacturing technologies, are driving a trend in the lighting industry toward the use of light emitting diodes (LEDs) or other solid state light sources to produce light for general lighting applications, as replacements for incandescent lighting and eventually as replacements for other older less efficient light sources.

The actual solid state light sources, however, produce light of specific limited spectral characteristics. To obtain white light of a desired characteristic and/or other desirable light colors, lighting devices based on solid state sources have typically used sources that produce light of two or more different colors or wavelengths. One technique involves mixing or combining individual light from LEDs of three or more different wavelengths (single or "primary" colors), for example from Red, Green and Blue LEDs. Another approach combines a white LED source, which tends to produce a cool bluish light, with one or more LEDs of specific wavelength(s) such as red and/or yellow chosen to shift a combined light output to a more desirable color temperature. Adjustment of the LED outputs offers control of intensity as well as the overall color output, e.g. color and/or color temperature of white light.

To provide efficient mixing of the various colors of the light and a pleasing uniform light output, Advanced Optical Technologies, LLC (AOT) of Herndon, Va. has developed a variety of light fixture configurations that utilize a diffusely reflective optical integrating cavity to process and combine the light from a number of solid state sources. By way of example, a variety of structures for AOT's lighting systems using optical integrating cavities are described in US Patent Application Publications 2007/0138978, 2007/0051883 and 2007/0045524, the disclosures of which are incorporated herein entirely by reference.

Although these integrating cavity based lighting systems/fixtures provide excellent quality light in an efficient manner and address a variety of concerns regarding other solid state lighting equipment, there is still room for improvement. For example, efficiency of the optical integrating cavity decreases if the diffuse reflectivity of its interior surface(s) is compromised, for example due to contamination from dirt or debris entering the cavity. Also, since the cavity is filled with air (low index of refraction), some light may be trapped in the LED packages by internal reflection at the package surface because the material used to encapsulate the LED chip may have a higher index of refraction. Efficiency may also be somewhat reduced if the mask or portion of the cavity around the aperture needs to have a relatively large size (producing a small optical aperture) to sufficiently reduce or prevent direct emissions from the solid state light source(s) through the cavity and optical aperture.

Hence a need exists for techniques to further improve optical integrating cavity type solid state lighting fixtures or systems.

SUMMARY

Various teachings or examples discussed herein alleviate one or more of the above noted problems and generally provide improvement over the prior optical integrating cavity type solid state lighting fixtures or systems using such fixture arrangements, by using a light transmissive solid to at least substantially fill the optical integrating volume.

The detailed description below discloses various examples of lighting apparatuses or fixtures, for providing general lighting in a region or area intended to be occupied by a person. In one example, an apparatus includes one or more solid state light emitters, which provide light intensity sufficient for a general lighting application. The apparatus also includes an assembly forming an optical integrating volume for receiving and optically integrating light from the one or more solid state light emitters and for emission of integrated light in a direction to facilitate that general lighting application. The assembly includes a reflector having a diffusely reflective interior surface defining a substantial portion of a perimeter of the optical integrating volume. The assembly also includes a light transmissive solid. This solid has a light emitter interface region, for each solid state light emitter, which closely conforms to the light emitting region of the solid state light emitter. A surface of the transmissive solid conforms closely to and is in proximity with the diffusely reflective interior surface of the reflector. The light transmissive solid also provides a light emission surface, at least a portion of which forms a transmissive optical passage for emission of integrated light, from the optical integrating volume, in a direction to facilitate the particular general lighting application in the region or area. The light transmissive solid fills at least a substantial portion of the optical integrating volume.

As noted, the intensity of light produced by the solid state light emitter(s) is sufficient for the fixture to support a general lighting application. Examples of general lighting applications include downlighting, task lighting, "wall wash" lighting, emergency egress lighting, as well as illumination of an object or person in a region or area intended to be occupied by people. A task lighting application, for example, typically requires a minimum of approximately 20 foot-candles (fcd) on the surface or level at which the task is to be performed, e.g. on a desktop or countertop. In a room, where the light fixture is mounted in or hung from the ceiling or wall and oriented as a downlight, for example, the distance to the task surface or level can be 35 inches or more below the output of the light fixture. At that level, the light intensity will still be 20 fcd or higher for task lighting to be effective.

The solid material effectively fills the light integrating volume. Optically, the volume is analogous to an optical integrating cavity. However, the presence of the solid prevents entry or dirt or debris, which might otherwise contaminate the diffuse reflector and reduce efficiency of reflection and thus reduce efficiency of the lighting apparatus over time.

Often, the material of each solid state light emitter has a high index of refraction in the vicinity of the light emitting region of the solid state device, e.g. the material encapsulating the light emitting portion of the LED chip. In several of the examples, the light transmissive solid has an index of refraction higher than an index of refraction of an ambient environment in the region or area of the general lighting application, although it may be somewhat less than that of the material used in or with the solid state emitters. The close conformity of the light emitter interface region of the solid, with the light emitting region of the solid state light emitter, provides improved efficiency of light extraction from the emitter package, by effectively reducing total internal reflection within the emitter package.

In some examples, the coupling between the transmissive solid and the emitter is provided with an optical adhesive between the interface of the transmissive solid and the light emitting region of the solid state light emitter to substantially eliminate any air gap. Depending on the type of solid material used, it may also be possible to mold the solid directly over the light emitting region of the solid state light emitter, to avoid creation of an air gap. Either approach provides a coupling at the interface region that is relatively free of low index of refraction air and thus reduces internal reflections inside the emitter package and improves light extraction efficiency.

The ambient environment outside the apparatus, e.g. air or water at the emission surface, exhibits a low index of refraction. In the examples in which the transmissive solid has an index of refraction higher than the ambient environment, the light emission surface of the transmissive solid tends to exhibit total internal reflection with respect to light reaching that surface from within the transmissive solid at relatively small angles of incidence with respect to that surface. In some examples, it is possible to utilize this total internal reflection to advantage to reduce the size of the mask or otherwise enlarge the effective aperture (size of the optical passage) through which light emerges from the integrating volume. As with the mask, light that is reflected back from the surface will be reflected by the diffuse reflector and typically will subsequently pass out through the exposed light emission surface (due to larger incident angle). Due to the larger optical aperture or passage, the apparatus can actually emit more light with fewer average reflections within the integrating volume, improving efficiency of the apparatus, yet still provide effective optical integration of light within the integrating volume.

Some types of LED solid state light emitters exhibit a substantially omni-directional emission pattern, that is to say a substantially circular (e.g. Lambertian) distribution of the light output. In several examples, each solid state light emitter is mounted tangentially with respect to the surface of the light transmissive solid that conforms to the reflector surface, in such an orientation that the omni-directional emissions of the emitter extend substantially outward into the light transmissive solid and away from any adjacent area of those surfaces of the light transmissive solid and reflector. In such an example of the lighting apparatus, the light emission surface of the light transmissive solid reflects a portion of direct emissions from each of the one or more solid state light emitters back into the optical integrating volume by total internal reflection.

A relatively small mask, for example, having a reflective surface covering a portion of the light emission surface of the light transmissive solid in proximity to the solid state light emitters, can reflect light that otherwise would impact the surface at too steep an angle for total internal reflection at the surface. The combination of the mask and the total internal reflection substantially prevents any direct emissions from the one or more solid state light emitters from emerging through the light emission surface of the light transmissive solid. However, the orientation of the emitter(s) tends to conform the emission pattern more closely to the shape of the diffusely reflective interior surface of the reflector and thereby avoid bright areas or "hot spots" on the reflective surface that might otherwise have been created by other orientations of the emitter(s).

The optical integrating volume and/or the optical passage for emission of integrated light may have a variety of different shapes, to facilitate different applications. Examples of the volume may be similar to hemispheres or half cylinders (or other portions of spheres or cylinders), although square, rectangular, conical, pyramidal and other shapes may be used. Where the volume is a segment of a sphere, the optical passage often will be circular. Where the volume is a segment of a cylinder, the optical passage often is rectangular.

Additional advantages and novel features will be set forth in part in the description which follows, and in part will become apparent to those skilled in the art upon examination of the following and the accompanying drawings or may be learned by production or operation of the examples. The advantages of the present teachings may be realized and attained by practice or use of various aspects of the methodologies, instrumentalities and combinations set forth in the detailed examples discussed below.

BRIEF DESCRIPTION OF THE DRAWINGS

The drawing figures depict one or more implementations in accord with the present teachings, by way of example only, not by way of limitation. In the figures, like reference numerals refer to the same or similar elements.

FIGS. 4D-1 to 4D-3 are enlarged cross sectional (D) views of a portion of the fixture of FIG. 4 at the location indicated by the oval D, showing different textures at surfaces of several components of the fixture for several different examples.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and circuitry have been described at a relatively high-level, without detail, in order to avoid unnecessarily obscuring aspects of the present teachings. Generally, the illustrations in the figures are not drawn to scale, but instead are sized to conveniently show various points under discussion herein.

The various examples discussed below relate to lighting fixtures or apparatuses using solid state light sources and/or to lighting systems incorporating such devices, in which at least a substantial portion of an optical integrating volume is filled with a light transmissive solid. Techniques for manufacturing certain elements of the fixture and methods of operating systems incorporating such a fixture also are briefly discussed in the description below. Reference now is made in detail to the examples illustrated in the accompanying drawings and discussed below.

Figure 1B:
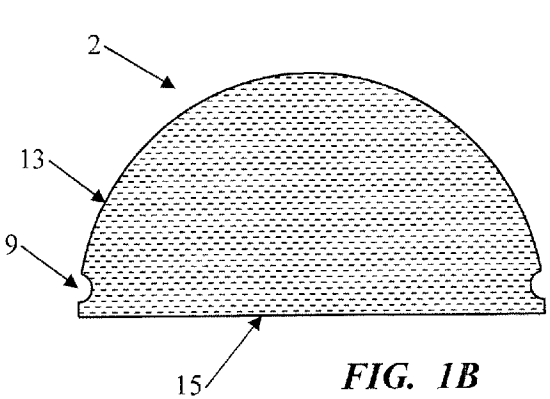
FIG. 1B is a cross section of the light transmissive solid used in the light fixture of FIG. 1A.
Figure 1A:
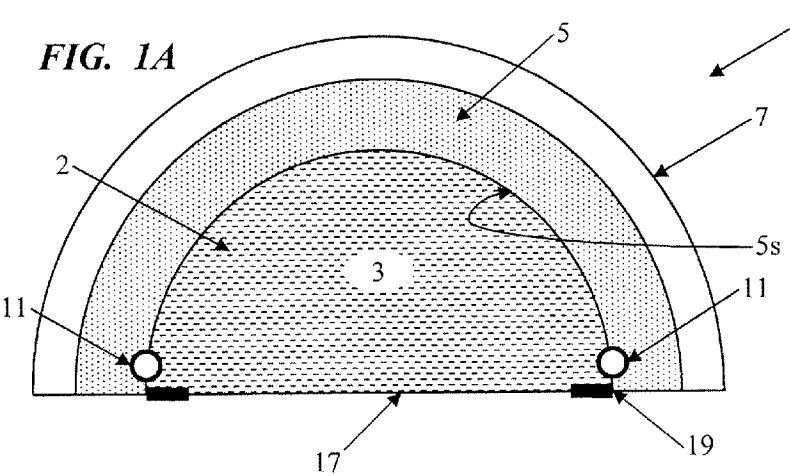
FIG. 1A is a cross section of a light fixture for a general lighting application, using an optical integrating volume at least a substantial portion of which is filled with a light transmissive solid, and a number of solid state light emitters.

FIG. 1A illustrates a first example of a lighting fixture or apparatus 1 having a light transmissive solid 2 substantially filling the optical integrating volume 3. In the example, the apparatus 1 also includes one or more solid state light emitters 11, which provide light intensity sufficient for a general lighting application.

In most of the examples, for convenience, the lighting apparatus is shown in an orientation for emitting light downward. However, the apparatus may be oriented in any desired direction to perform a desired general lighting application function. A light emission surface or exposed portion thereof on the transmissive solid functions as an "optical aperture" of the integrating volume. That effective optical aperture or a further optical processing element may provide the ultimate output of the apparatus for a particular general lighting application. As discussed in detail with regard to FIGS. 1A and 1B, but applicable to all of the examples, circular or hemispherical shapes are shown (generally in cross-section) and discussed, most often for convenience, although a variety of other shapes may be used.

The apparatus or fixture 1 includes an assembly forming the optical integrating volume 3, for receiving and optically integrating light from the one or more solid state light emitters 11 and for emission of integrated light in a direction to facilitate that general lighting application. The assembly includes the light transmissive solid 2. FIG. 1B shows the solid 2 separately. As shown, the light transmissive solid 2 has a light emitter interface region 9, for each solid state light emitter 11, which closely conforms to the light emitting region of the respective solid state light emitter 11. The solid 2 also has a curved outer surface 13. The light transmissive solid also provides a light emission surface, shown at 15 in FIG. 1B.

The light emitter interface region or regions 9 (and thus the couplings for receiving light from the solid state light emitters 11) may be positioned at any of a variety of different locations and/or oriented in different directions, although as discussed in more detail later regarding various examples, the position and orientation will be chosen to minimize or eliminate direct passage of emitted light from the source(s) 11 through the effective optical aperture of the optical integrating volume 3 and instead provide one or more reflections of substantially all light from the emitters before passage out of the volume 3.

The assembly forming the optical integrating volume 3 also includes a reflector having a curved diffusely reflective interior surface defining a substantial portion of a perimeter of the optical integrating volume. In the example of FIG. 1, the reflector is formed pressed poly tetrafluoroethylene (PTFE) granular 5. The powder of the PTFE reflector 5 is pressed between a curved inner surface of a solid support member or substrate material 7 and the outer surface of the light transmissive solid 2. In this way, the curved surface of the transmissive solid conforms closely to and is in proximity with the curved diffusely reflective interior surface of the reflector and/or the PTFE reflector 5 has a diffusely reflective inner surface 5*s* closely conforming to the outer surface of the light transmissive solid 2.

At least a portion 17 (FIG. 1A) of the light emission surface 15 (FIG. 1B) of the light transmissive solid 2 serves as a transmissive optical passage or effective "optical aperture" for emission of integrated light, from the optical integrating volume 3, in a direction to facilitate the particular general lighting application in the region or area. The entire surface 15 of the solid could provide light emission. However, the example of FIG. 1 includes a mask 19 having a reflective surface facing into the optical integrating volume 3, which somewhat reduces the surface area forming the transmissive passage to that portion of the surface shown at 17. The integrating volume 3 operates as an optical integrating cavity (albeit one filled with the light transmissive solid), and the passage 17 for light emission forms the optical aperture of the cavity. However, the presence of the solid protects the reflective surface 5*s* from contamination by dirt or debris that might enter an open aperture/cavity arrangement.

Figure 2:
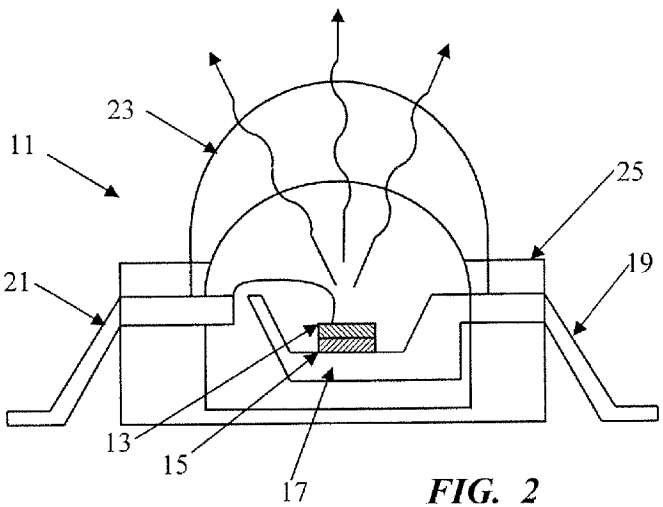
FIG. 2 is a simplified cross-sectional view of a light-emitting diode (LED) type source package, which may be used in the fixture of FIG. 1A.

FIG. 2 illustrates, in cross section, an example of one type of LED type solid state light source 11 as implemented in a package form factor. In the example of FIG. 2, the LED type source 11 includes a semiconductor chip, comprising two or more semiconductor layers 13, 15 forming the actual LED. The semiconductor layers 13, 15 are mounted on an internal reflective cup 17, formed as an extension of a first electrode, e.g. the cathode 19. The cathode 19 and anode 21 provide electrical connections to layers of the semiconductor device within the package. An epoxy dome 23 (or similar transmissive part) of the enclosure 25 allows for emission of the light or other energy from the chip in the desired direction. Internal reflectors, such as the reflective cup 17, direct energy in the desired direction and reduce internal losses.

The solid 2 and reflector 5 may be shaped so that optical integrating cavity formed by the optical volume 3 may have any one of a variety of different shapes. For purposes of the discussion of the first example, the optical integrating volume 3 is assumed to be hemispherical. In such an example, a hemispherical reflective surface 5*s* and the combination of the reflective mask 19 and the total internal reflection along region 17 of the emission surface define the boundaries along the perimeter of the hemispherical optical integrating volume 3. At least the interior facing surface(s) 5*s* of the reflector 5 is highly diffusely reflective, so that the resulting volume 3 is highly diffusely reflective with respect to the radiant energy spectrum produced by the apparatus 1. The interior facing surface(s) of the mask 19 is reflective, typically specular or diffusely reflective. In this way, the reflectivity in the volume 3 causes the volume to process light in a manner essentially the same as in an optical integrating cavity.

The cross-section of the optical integrating volume 3 illustrated in FIG. 1A would be substantially the same if the volume is hemispherical or nearly hemispherical (assumed hemispherical in the above discussion) or if the volume is semi-cylindrical with a lateral cross-section taken perpendicular to the longitudinal axis of the semi-cylinder. Hemispherical or semi-cylindrical shapes are preferred for ease of discussion, illustration and modeling; but in actual fixture design and operation, a much wider range of shapes may be used effectively. For example, the volume may correspond to a segment of a sphere other than a hemisphere, a segment of a cylinder other than a semi-cylindrical or hemi-cylindrical shape; or volumes of rectangular cross section or pyramidal volumes may be used.

It is desirable that the diffusely reflective surface(s) 5*s* of the reflector 5 have a highly efficient reflective characteristic, e.g. a reflectivity equal to or greater than 90%, with respect to the relevant wavelengths. The entire interior surface 5*s* of the reflector 5 may be diffusely reflective, or one or more substantial portions may be diffusely reflective while other portion(s) of the surface may have different light reflective characteristics, such as a specular or semi-specular characteristic. As noted, the surface of the mask 19 that faces into the optical integrating volume 3 (faces upward in the illustrated orientation) is reflective. That surface may be diffusely reflective, much like the surface 5*s*, or that mask surface may be specular, quasi specular or semi-specular. Other surfaces of the mask 19 may or may not be reflective, and if reflective, may exhibit the same or different types/qualities of reflectivity than the surface of the mask 19 that faces into the optical integrating volume 3.

In this example, the optical integrating volume 3 has a transmissive optical aperture formed by the exposed region 17 of the emission surface of the solid 2. This effective optical aperture at 17 allows emission of reflected and diffused light integrated within the interior of the integrating volume 3 into a region to facilitate a humanly perceptible general lighting application for the fixture 1. Although shown as approximately centered with respect to the emission surface of the solid 2 and thus with respect to the volume 3, the transmissive passage at 17 forming the optical aperture may be located elsewhere along the surface 15 or at some appropriate region of the fixture that is transmissive (e.g. not covered by a reflector 5 or 19). One or more additional passages may be provided at other locations on the assembly of reflector 5 and solid 2 forming the optical integrating volume 3.

The effective optical aperture at 17 forms a virtual source of the light from lighting apparatus or fixture 1. Essentially, electromagnetic energy, typically in the form of light energy from the one or more solid state sources 11, is diffusely reflected and integrated within the volume 3 as outlined above. This integration forms combined light for a virtual source at the output of the volume, that is to say at the effective optical aperture at 17. The integration, for example, may combine light from multiple sources or spread light from one small source across the broader area of the effective aperture at 17. The integration tends to form a relatively Lambertian distribution across the virtual source. When the fixture illumination is viewed from the area illuminated by the combined light, the virtual source at 17 appears to have substantially infinite depth of the integrated light. Also, the visible intensity is spread uniformly across the virtual source, as opposed to one or more individual small point sources of higher intensity as would be seen if the one or more solid state sources were directly observable without sufficient diffuse processing before emission through an aperture.

Pixelation and color striation are problems with many prior solid state lighting devices. When a non-cavity type LED fixture output is observed, the light output from individual LEDs or the like appear as identifiable/individual point sources or 'pixels.' Even with diffusers or other forms of common mixing, the pixels of the sources are apparent. The observable output of such a prior system exhibits a high maximum-to-minimum intensity ratio. In systems using multiple light color sources, e.g. RGB LEDs, unless observed from a substantial distance from the fixture, the light from the fixture often exhibits striations or separation bands of different colors.

In systems and light fixtures as disclosed herein, however, optical integrating volume 3 converts the point source output (s) of the one or more solid state light emitting elements 11 to a virtual source output of light, at the effective optical aperture formed at region 17, which is free of pixilation or striations. The virtual source output is unpixelated and relatively uniform across the apparent output area of the fixture, e.g. across the portion 17 of the emission surface of the solid 2 in this first example (FIG. 1A). The optical integration sufficiently mixes the light from the solid state light emitting elements 11 that the combined light output of the virtual source is at least substantially Lambertian in distribution across the optical output area of the cavity, that is to say across the effective optical aperture at 17. As a result, the light output exhibits a relatively low maximum-to minimum intensity ratio across that region 17. In virtual source examples discussed herein, the virtual source light output exhibits a maximum to minimum ratio of 2 to 1 or less over substantially the entire optical output area. The area of the virtual source is at least one order of magnitude larger than the area of the point source output of the solid state emitter 11.

In this way, the diffuse optical processing may convert a single small area (point) source of light from a solid state emitter 11 to a broader area virtual source at the region 17. The diffuse optical processing can also combine a number of such point source outputs to form one virtual source at the region 17.

As noted above, the light emitter interface region 9 of the light transmissive solid 2 for each solid state light emitter 11 closely conforms to the light emitting region of the respective solid state light emitter 11. Using the LED package type source 11 (FIG. 2) as an example, the contour of region 9 (FIG. 1B) would closely conform to the outer surface of the epoxy dome 23. For that purpose, the light transmissive solid 2 may be molded to the sources 11, or the LED sources 11 may be bonded to the respective light emitter interface regions 9 by an optical adhesive of an appropriate index of refraction. As a result, there should be little or no air in any gap between the outer surface of the dome 23 of the source 11 and the mating light emitter interface region 9 of the light transmissive solid 2. The arrangement of the light emitter interface region 9 of the light transmissive solid 2 to conform to the light emitting region at the outer surface of the epoxy dome 23 of the LED type light source 11 therefore provides a coupling that is relatively free of low index of refraction air at the light output of the source 11 and thus reduces internal reflections inside the emitter package (e.g. inside the dome 23), which improves efficiency of light extraction from each of the solid state sources 11.

Typically, each of the LED type solid state light sources 11 has a high index of refraction in the vicinity of its light emitting region, e.g. in the form of an epoxy or other material covering the LED chip but allowing emission of the light output from the LED. In the example of FIG. 2, the dome 23 would exhibit the high index of refraction. The light transmissive solid 2 has an index of refraction that is at least higher than the index of refraction of an ambient environment in the region or area illuminated in the particular lighting application. Vacuum has an index of refraction of 1, and air in a room to be inhabited by people typically has a slightly higher index of refraction. For applications in such environments, the light transmissive solid 2 will have an index of refraction higher than the air. For applications in water, e.g. for pool or spa lighting, the light transmissive solid will have an index of refraction higher than the water. Hence, LED type sources 11 may use materials having an index of refraction in a range of 3 to 4. Although for some applications it may be desirable to use a similar light transmissive solid 2, having an index of refraction in a range of 3 to 4, for other applications it may be sufficient to use relatively inexpensive glass having an index of refraction around 1.3 to 1.5 (which is still higher than that of the air).

The ambient environment outside the apparatus, e.g. air or water at the emission surface 17, exhibits a low index of refraction. Since the transmissive solid 2 has an index of refraction higher than the ambient environment, the portion 17 of the light emission surface of the transmissive solid 2 that serves as the optical aperture or passage out of the integrating volume 3 tends to exhibit total internal reflection with respect to light reaching that surface from within the transmissive solid at relatively small angles of incidence with respect to that surface. Consider FIG. 3 by way of a simple example. Light emitted at a low angle from the source 11 (right side source used as the example for discussion purposes) impacts the portion 17 of the light emission surface, and total internal reflection at that portion of the surface reflects the light back into the optical integrating volume 3. In contrast, light that has been diffusely reflected from regions of the surface 5*s* of the reflector arriving at larger angles to the surface are not subject to total internal reflection and pass through portion 17 of the light emission surface of the transmissive solid 2.

The mask 19 therefore can be relatively small in that it only needs to extend far enough out covering the light emission surface of the transmissive solid 2 so as to reflect those direct emissions of the light sources 11 that would otherwise impact the light emission surface of the transmissive solid at too high or large an angle for total internal reflection. In this way, the combination of total internal reflection in the portion 17 of the emission surface of the solid 2 together with the reflective mask 19 reflects all or at least substantially all of the direct emissions from the sources 11 back into the optical integrating volume. Stated another way, a person in the area or region illuminated by the fixture 1 would not perceive the LEDs at 11 as visible individual light sources. Instead, all light from the sources 11 will reflect one or more times from the surface 5*s* before emergence through the portion 17 of the emission surface of the solid 2. Since the surface 5*s* provides diffuse reflectivity, the volume 3 acts as an optical integrating cavity so that the portion 17 of the emission surface of the solid 2 provides a substantially uniform output distribution of integrated light (e.g. substantially Lambertian).

Hence, it is possible to utilize the total internal reflection to reduce the size of the mask 19 or otherwise enlarge the effective aperture (size of the optical passage) at 17 through which light emerges from the integrating volume 3. Due to the larger optical aperture or passage, the apparatus 1 can actually emit more light with fewer average reflections within the integrating volume, improving efficiency of the apparatus in comparison to prior fixtures that utilized cavities and apertures that were open to air.

The intensity of light produced by the solid state light emitter(s) 11 is sufficient for use of light emitted through the surface region 17 forming the optical aperture of the integrating volume 3 to support a general lighting application for the fixture 1. Examples of general lighting applications include downlighting, task lighting, "wall wash" lighting, emergency egress lighting, as well as illumination of an object or person in a region or area intended to be occupied by people. A task lighting application, for example, typically requires a minimum of approximately 20 foot-candles (fcd) on the surface or level at which the task is to be performed, e.g. on a desktop or countertop. In a room, where the light fixture 1 is mounted in or hung from the ceiling or wall and oriented as a downlight, for example, the distance to the task surface or level can be 35 inches or more below the output of the light fixture. At that level, the light intensity will still be 20 fcd or higher for task lighting to be effective.

As discussed herein, applicable solid state light emitting elements, sources or emitter, such as shown at 11 in the example of FIG. 1A, essentially include any of a wide range of light emitting or generating devices formed from organic or inorganic semiconductor materials. Examples of solid state light emitting elements include semiconductor laser devices and the like. Many common examples of solid state lighting elements, however, are classified as types of "light emitting diodes" or "LEDs." This exemplary class of solid state light emitting devices encompasses any and all types of semiconductor diode devices that are capable of receiving an electrical signal and producing a responsive output of electromagnetic energy. Thus, the term "LED" should be understood to include light emitting diodes of all types, light emitting polymers, organic diodes, and the like. LEDs may be individually packaged, as in the illustrated examples. Of course, LED based devices may be used that include a plurality of LEDs within one package, for example, multi-die LEDs that contain separately controllable red (R), green (G) and blue (B) LEDs within one package. Those skilled in the art will recognize that "LED" terminology does not restrict the source to any particular type of package for the LED type source. Such terms encompass LED devices that may be packaged or non-packaged, chip on board LEDs, surface mount LEDs, and any other configuration of the semiconductor diode device that emits light. Solid state lighting elements may include one or more phosphors and/or quantum dots, which are integrated into elements of the package or light processing elements of the fixture to convert at least some radiant energy to a different more desirable wavelength or range of wavelengths.

The color or spectral characteristic of light or other electromagnetic radiant energy relates to the frequency and wavelength of the radiant energy and/or to combinations of frequencies/wavelengths contained within the energy. Many of the examples relate to colors of light within the visible portion of the spectrum, although some fixtures may utilize or emit other energy, e.g. to pump emissions from phosphors or quantum dots.

It also should be appreciated that solid state light emitting elements 11 may be configured to generate electromagnetic radiant energy having various bandwidths for a given spectrum (e.g. narrow bandwidth of a particular color, or broad bandwidth centered about a particular), and may use different configurations to achieve a given spectral characteristic. For example, one implementation of a white LED may utilize a number of dies that generate different primary colors which combine to form essentially white light. In another implementation, a white LED may utilize a semiconductor that generates light of a relatively narrow first spectrum in response to an electrical input signal, but the narrow first spectrum acts as a pump. The light from the semiconductor "pumps" a phosphor material or quantum dots contained in the LED package, which in turn radiates a different typically broader spectrum of light that appears relatively white to the human observer.

In a typical implementation, a system incorporating the light fixture 1 also includes a controller. An example of a suitable controller and associated user interface elements is discussed in more detail later with regard to FIG. 17.

The example of FIGS. 1A and 1B would essentially be manufactured by forming the solid 2 of the desired shape, e.g. with the desired contour for its outer surface 13 and forming the solid support member or substrate material 7. The light sources 11 are positioned in mating relation with the corresponding light emitter interface regions 9. Granular PTFE power is placed inside the support 7, and the solid 2 is pressed into the powder. Pressing the solid into the powder compresses the PTFE into a relatively stable matrix. Any excess PTFE is expelled. The mask 19 may be manufactured by any appropriate means and attached, coated, treated or otherwise formed at the desired location on the surface 15, to produce the fixture essentially as shown in cross-section in FIG. 1A.

The light transmissive solid 2 may be made of glass, acrylic or the like. The precise material may be substantially transparent. Alternatively, the solid 2 may have embedded scattering components to provide diffusion or the material may be somewhat translucent to provide added diffusion.

It may also be desirable to add phosphors or quantum dots to the fixture 1, to provide a wavelength or color shift for at least some of the light. Such materials could be added at the junction or interface of the solid (curved outer surface) to the reflective surface of the pressed PTFE forming the reflector, e.g. in the reflector with the PTFE powder or between the surfaces of the reflector and the light transmissive solid. Alternatively, phosphor or quantum dots could be included in the material of the solid or used to coat the light emission region 17. Phosphors absorb excitation energy then re-emit the energy as radiation of a different wavelength than the initial excitation energy. For example, some phosphors produce a down-conversion referred to as a "Stokes shift," in which the emitted radiation has less quantum energy and thus a longer wavelength. Other phosphors produce an up-conversion or "Anti-Stokes shift," in which the emitted radiation has greater quantum energy and thus a shorter wavelength. Quantum dots provide similar shifts in wavelengths of light. Quantum dots are nano scale semiconductor particles, typically crystalline in nature, which absorb light of one wavelength and re-emit light at a different wavelength, much like conventional phosphors. However, unlike conventional phosphors, optical properties of the quantum dots can be more easily tailored, for example, as a function of the size of the dots. In this way, for example, it is possible to adjust the absorption spectrum and/or the emission spectrum of the quantum dots by controlling crystal formation during the manufacturing process so as to change the size of the quantum dots. Thus, quantum dots of the same material, but with different sizes, can absorb and/or emit light of different colors. For at least some exemplary quantum dot materials, the larger the dots, the redder the spectrum of re-emitted light; whereas smaller dots produce a bluer spectrum of re-emitted light.

The structure, materials and manufacturing techniques as outlined above relative to FIGS. 1A and 1B are given by way of example. Those skilled in the art will recognize the viability of a variety of other approaches. However, it may be helpful to consider a few additional examples.

Figure 4:
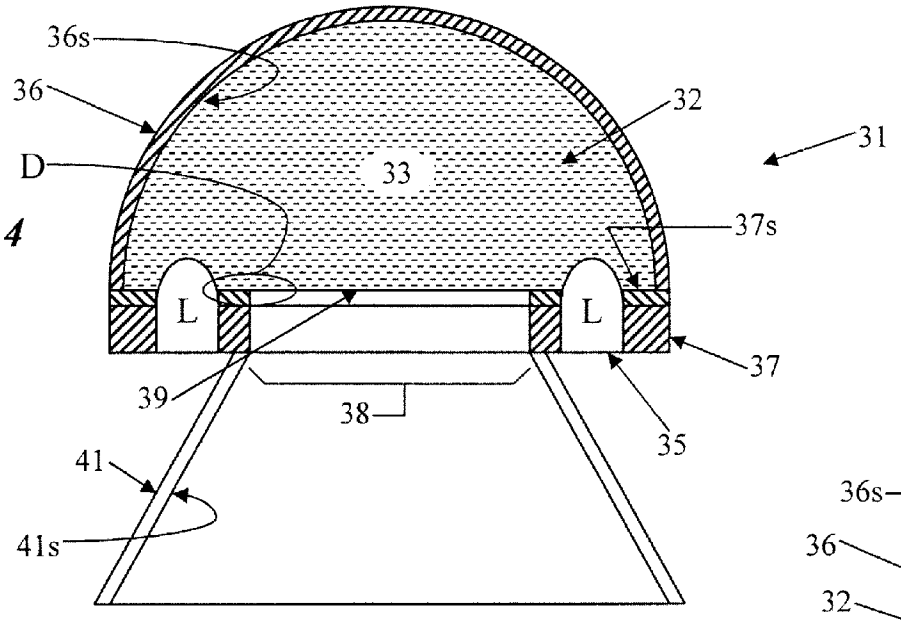
FIG. 4 is a cross section of another example of a light fixture using a light transmissive solid in the optical integrating volume.

FIG. 4 illustrates one such example of another arrangement of a light fixture 31 with a light transmissive solid 32 filling at least a substantial portion of an optical integrating volume or cavity 33. In this example, the apparatus 31 also includes solid state light emitters in the form of light emitting diodes or "LEDs" (L) 35, which provide light intensity sufficient for a general lighting application. The LEDs 35 may be similar to the devices shown in FIG. 2 or any other commercially available LED devices. As in the earlier example, the solid is light transmissive (transparent or translucent) of an appropriate material such as acrylic or glass. The solid forms the integrating volume because it is bounded by reflective surfaces 36*s* and 37*s* which form a substantial portion of the perimeter of the volume 33. Stated another way, the assembly forming the optical integrating volume 33 in this example comprises the light transmissive solid 32, a reflector 36 having a reflective interior surface 37 and a board or plate 37 having a reflective inward facing surface 37*s* (shown as a layer on the board or plate 37) that serves as a mask.

The optical integrating volume 33 is a diffuse optical processing element used to convert a point source input, typically at an arbitrary point not visible from the outside, to a virtual source. At least a portion of the interior surface of the optical integrating volume 33 exhibits a diffuse reflectivity. Hence, in the example, the surface 36*s* is highly diffusely reflective (90% or more and possibly 98% or higher). The surface 37*s* is reflective. Surface 37*s* may be diffusely reflective in a manner similar to the surface 36*s*, or some or all of the surfaces 36*s* may exhibit a different type or quality of reflectivity, e.g. specular or quasi-specular.

As in the earlier example, the optical integrating volume 33 may have various shapes. The illustrated cross-section would be substantially the same if the cavity is hemispherical or if the cavity is semi-cylindrical with a lateral cross-section taken perpendicular to the longitudinal axis of the semi-cylinder. For purposes of the discussion, the optical integrating volume 33 in the fixture 31 is assumed to be hemispherical or nearly hemispherical. Hence, the solid 32 would be a hemispherical or nearly hemispherical solid, and the reflector 36 would exhibit a slightly larger but concentric hemispherical or nearly hemispherical shape at least along its internal surface, although the hemisphere would be hollow but for the filling thereof by the solid 32. In practice, the reflector may be formed of a solid material or as a reflective layer on a solid substrate and the solid molded into the reflector. Another approach might involve forming the solid 32 and forming the reflector 36 (and possibly a reflector for the reflective surface 37*s*) as a paint or coating over appropriate regions of the outer surface of the solid 32. A yet further alternative would be to form the reflector and solid separately but to have the appropriate mating surface shapes and then position the solid within the reflector. With this later approach, it may be desirable to use an optical adhesive between the relevant surfaces of the solid and the reflector. In any event, contours of the reflective surface 36*s* and the outer curved surface of the light transmissive solid 32 typically conform closely to each other, much as did the corresponding surfaces in the example of FIG. 1A. As outlined in the discussion of FIG. 1A, the fixture may also include phosphors or quantum dots, e.g. in the reflector, in a layer between the reflector and the solid, in the solid or as a coating on the exposed region 39 of the surface of the solid.

In the example of FIG. 4, parts of the light emission surface of the solid 32 (lower flat surface in the illustrated orientation) are masked by the reflective surface 37*s* formed on the plate 37. The plate is shown as a flat horizontal member, and the mask surface 37*s* is shown as a flat surface, for convenience, although curved or angled configurations may be used. At least some substantial portions of the interior facing reflective surfaces 36*s* and 37*s* are highly diffusely reflective, so that the resulting optical integrating volume 33 is highly diffusely reflective with respect to the radiant energy spectrum produced by the fixture 31.

In this example, the optical integrating volume 33 forms an integrating type optical cavity. The optical integrating volume 33 has a transmissive optical passage or aperture. In this case, the optical aperture corresponds to a physical opening 38 through the plate 37. However, the optical aperture is formed by the portion 39 of the flat surface of the hemispherical light transmissive solid 32 exposed through the opening 38 on the plate 37. Passage from the surface portion 39 through the plate opening 38 allows emission of reflected and diffused light from within the interior of the optical integrating volume 33 into a region to facilitate a humanly perceptible general lighting application for the fixture 31. Although shown at approximately the center of the plate 37, the opening 38 and the corresponding transmissive passage 39 forming the effective optical aperture may be located elsewhere along the plate 37 or at some appropriate region of the dome shaped reflector 36. In the example, the effective optical aperture forms the virtual source of the light from lighting apparatus or fixture 31, for uniform light output as discussed above relative to the example of FIG. 1A.

As noted earlier, the lighting fixture 31 also includes at least one LED (L) type light source 35. The LEDs (L) 35 may emit a single type of visible light, white light of one or more color temperatures, a number of colors of visible light, or light of one or more wavelengths in another part of the electromagnetic spectrum selected to pump phosphors or quantum dots present in the fixture or combinations thereof. The LEDs (L) 35 may be positioned at a variety of different locations and/or oriented in different directions. Various couplings and various light entry locations may be used. In this and other examples, each LED (L) 35 is coupled to supply light to enter the optical integrating volume 33 at a point that directs the light toward a reflective surface 36*s* (or possibly 37*s*) so that it reflects one or more times inside the optical integrating volume 33. At least one such reflection is a diffuse reflection. As a result, the direct emissions from the sources 35 would not directly pass through the optical aperture formed at region 39 of the surface of the solid and are not directly observable through the aperture and opening from the region illuminated by the fixture output. The LEDs (L) 35 therefore are not perceptible as point light sources of high intensity, from the perspective of an area illuminated by the light fixture 31.

Many of the examples of fixtures using the structure of FIG. 4 use and produce colors of light within the visible portion of the spectrum, although examples also are discussed that utilize or emit other energy, e.g. to pump emissions by phosphors or quantum dots in the fixture. Electromagnetic energy, typically in the form of light energy from the one or more LEDs (L) 35, is diffusely reflected and combined within the optical integrating volume 33 to form combined light and form a virtual source of such combined light at the optical aperture. Such integration, for example, may combine light from multiple sources or spread light from one small source across the broader area of the effective optical aperture. The integration may also combine light from phosphors or quantum dots. The integration tends to form a relatively Lambertian distribution across the virtual source at 39. When the fixture illumination is viewed from the area illuminated by the combined light, the virtual source at effective optical aperture 39 appears to have substantially infinite depth of the integrated light. Also, the visible intensity is spread uniformly across the virtual source, as opposed to one or more individual small point sources of higher intensity as would be seen if the one or more LED source elements (L) 35 were directly observable without sufficient diffuse processing before emission through the aperture. As in the earlier virtual source example, the virtual source output at the aperture appears free of pixilation or color striation and is highly uniform across the area of the aperture, e.g. exhibiting a relatively low maximum-to-minimum intensity ratio across the aperture of say 2 to 1 or less over substantially the entire optical output area. The area of the virtual source is at least one order of magnitude larger than the area of the point source output of the solid state emitter 35.

It also should be appreciated that solid state light emitting elements 35 may be configured to generate electromagnetic radiant energy having various bandwidths for a given spectrum (e.g. narrow bandwidth of a particular color, or broad bandwidth centered about a particular), and may use different configurations to achieve a given spectral characteristic. For example, one implementation of a white LED may utilize a number of dies that generate different primary colors which combine to form essentially white light. In another implementation, a white LED may utilize a semiconductor that generates light of a relatively narrow first spectrum in response to an electrical input signal, but the narrow first spectrum acts as a pump. The light from the semiconductor "pumps" a phosphor material or quantum dots contained in the LED package or the fixture, which in turn radiates a different typically broader spectrum of light that appears relatively white to the human observer.

The opening 38 and the exposed portion 39 of the surface of the solid 32 may serve as the light output if the fixture 31, directing integrated color light of relatively uniform intensity distribution to a desired area or region to be illuminated in accord with the general lighting application. It is also contemplated that the fixture 31 may include one or more additional processing elements coupled to the effective optical aperture, such as a colliminator, a grate, lens or diffuser (e.g. a holographic element). In the example of FIG. 4, the fixture 31 includes a further optical processing element in the form of a deflector or concentrator 41 coupled to the opening 38, to distribute and/or limit the light output to a desired field of illumination.

The deflector or concentrator 41 has a reflective inner surface 41*s*, to efficiently direct most of the light emerging from the optical integrating volume 33 into a relatively narrow field of view. A small opening at a proximal end of the deflector 41 is coupled to the opening 38. The deflector 41 has a larger opening at a distal end thereof. Although other shapes may be used, such as parabolic reflectors, the deflector 41 in this example is conical, essentially in the shape of a truncated cone. The angle of the cone wall(s) and the size of the distal opening of the conical deflector 41 define an angular field of light energy emission from the apparatus 31. Although not shown, the large opening of the deflector 41 may be covered with a transparent plate or lens, or covered with a grating, to prevent entry of dirt or debris through the cone into the deflector 41 and/or to further process the output light energy.

The conical deflector 41 may have a variety of different shapes, depending on the particular lighting application. In the example, where solid 32 and reflector 36 are hemispherical and the opening 38 and exposed surface region 39 are most likely circular, the cross-section of the conical deflector 41 is typically circular. However, the deflector 41 may be somewhat oval in shape. Although the effective optical aperture may be round, the distal opening may have other shapes (e.g. oval, rectangular or square); in which case more curved reflector walls provide a transition from round at the proximal opening (matching opening 38) to the alternate shape at the proximal opening. In applications using a semi-cylindrical cavity, the deflector may be elongated or even rectangular in cross-section. The shape of the opening and exposed surface region also may vary, but will typically match the shape of the small end opening of the deflector 41. Hence, in the example, the opening 38 would be circular and would expose a circular portion 39 of the surface of the solid 32, and the matching proximal opening at the small end of the conical deflector 41 also would be circular. However, for a device with a semi-cylindrical shaped optical integrating volume and a deflector with a rectangular cross-section, the opening, exposed region and associated deflector opening all may be rectangular with square or rounded corners.

The deflector 41 comprises a reflective interior surface 41*s* between the distal end and the proximal end. In some examples, at least a substantial portion of the reflective interior surface 41*s* of the conical deflector 41 exhibits specular reflectivity with respect to the integrated radiant energy. As discussed in U.S. Pat. No. 6,007,225, for some applications, it may be desirable to construct the deflector 41 so that at least some portion(s) of the inner surface 41*s* exhibit diffuse reflectivity or exhibit a different degree of specular reflectivity (e.g., quasi-secular), so as to tailor the performance of the deflector 41 to the particular general lighting application. For other applications, it may also be desirable for the entire interior surface 41*s* of the deflector 41 to have a diffuse reflective characteristic. In addition to reflectivity, the deflector may be implemented in different colors (e.g. silver, gold, red, etc.) along all or part of the reflective interior surface 41*s*.

In the illustrated example, the large distal opening of the deflector 41 is roughly the same size as the structure or assembly forming the optical integrating volume 33. In some applications, this size relationship may be convenient for construction purposes. However, a direct relationship in size of the distal end of the deflector 41 and the volume 33 or the reflector 36 is not required. The large end of the deflector 41 may be larger or smaller than the integrating volume and reflector structure. As a practical matter, the size of the optical integrating volume 33 is optimized to provide effective integration or combination of light from the desired number of LED type solid state sources 35. The size, angle and shape of the deflector 41 determine the area that will be illuminated by the combined or integrated light emitted from the integrating volume 33 via the aperture at the exposed surface region 39 (via the opening 38 through the plate 37). Although shown as open to the environment in this example, the volume of the deflector 41 could be filled with the solid or another solid.

For convenience, the illustration shows the lighting apparatus 31 emitting the light downward from the virtual source, that is to say downward through the effective optical aperture at the exposed portion 39 of the solid surface. However, the apparatus 31 may be oriented in any desired direction to perform a desired general lighting application function. Also, the optical integrating volume 33 may have more than one optical aperture or passage, for example, oriented to allow emission of integrated light in two or more different directions or regions. The additional optical passage may be formed by an opening or a partially transmissive or translucent region of any reflector 36 or 37 around the solid 32, which exposes another portion of surface of the solid 32 so as to permit additional integrated light emission from the volume 33.

Although not always required, in a typical implementation, a system incorporating the light fixture 31 also includes a controller. An example of a suitable controller and associated user interface elements is discussed in more detail later with regard to FIG. 17.

Figure 3:
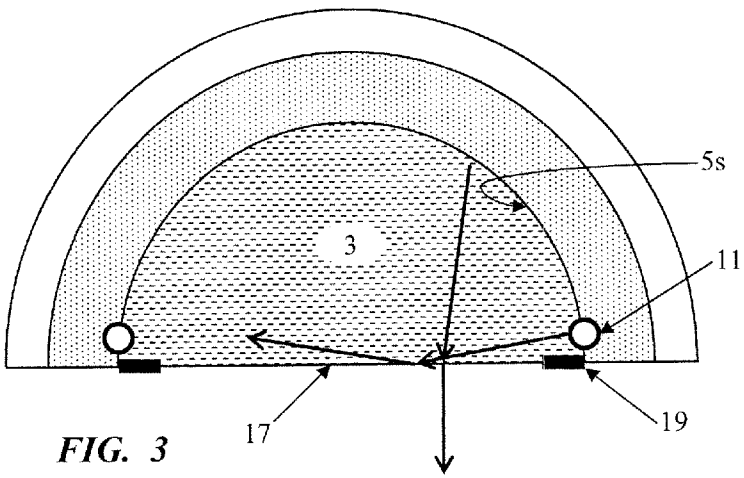
FIG. 3 shows several light rays overlaid on the cross section of the light fixture of FIG. 1, useful in explaining certain reflections and emissions at the effective optical aperture of the integrating volume formed by the exposed portion of the light emission surface of the transmissive solid.
Figures 2, 4D:
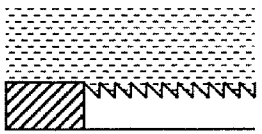
Figures 1, 4D:
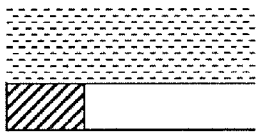
Figures 3, 4D:
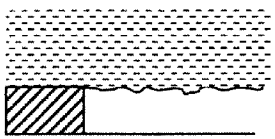

FIGS. 4D-1 to 4D-3 are enlarged cross sectional (D) views of a portion of the fixture of FIG. 4 at the location indicated by the oval D. These views are useful in understanding that the exposed surface of the transmissive solid, through which light emerges from the optical integrating cavity, may have a variety of different textures. These drawings relate to the example of FIG. 4, but similar textures may be used on the relevant surface region in the fixture of FIG. 1A, as well as other exemplary fixtures discussed below.

FIG. 4D-1 shows an example in which the exposed surface region of the light transmissivie solid is smooth, for example, as produced by polishing at least the appropriate portion of the surface of the solid material. FIG. 4D-2 depicts an example in which the exposed region or portion of the solid surface is roughened. In that example, the roughening is shown as a regular pattern such as a saw tooth pattern, although other regular patterns may be provided by appropriate processing of the relevant portion of the surface. FIG. 4D-3 shows another similar example with a roughened surface region, but with an irregular contour or texture. Such a roughening of the surface may be provided by bead blasting or the like.

Figure 5:
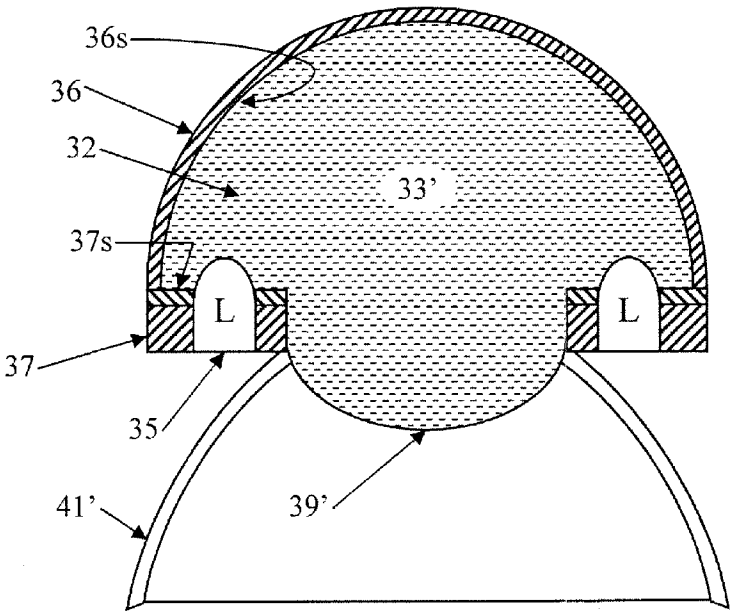
FIG. 5 is a cross section of an example of a light fixture, similar to that of FIG. 4, but in which the exposed portion of the surface of the light transmissive solid is convex at the passage where integrated light emerges from the volume.

FIG. 5 is a cross section of an example of a light fixture 31', similar to that of FIG. 4. In general, the elements of the fixture 31' are similar to the elements of the fixture of FIG. 4 and are indicated by the same reference numerals; and for convenience, detailed discussion of the similar elements is omitted here. In the fixture 31' of FIG. 5, the solid 32' and thus the volume 33' have a somewhat different shape than corresponding elements shown in FIG. 4. In this example, the light transmissive solid 32' is convex at the passage where integrated light emerges from the volume. Hence, the portion 39' of the surface of the solid that is exposed for light emission extends outward in a curved convex shape. Those skilled in the art will recognize that the solid may exhibit a variety of different shapes in the region corresponding to 39 or 39' where light is emitted from the transmissive solid. The shape in the region 39 or 39' is chosen to distribute the light emitted from the integrating volume in a manner that facilitates the particular lighting application.

The example of FIG. 5 also includes a deflector similar to that of FIG. 4. However, the deflector 41' of the fixture 31' shows an example of just one alternate shape for the deflector. Instead of the truncated cone shape illustrated in cross-section in FIG. 4, FIG. 5 shows a curved shaped deflector 41'. A curved deflector may have a parabolic shape or other curved shaped selected to concentrate emitted light in a desired field of illumination that facilitates a particular general lighting application.

Figure 6A:
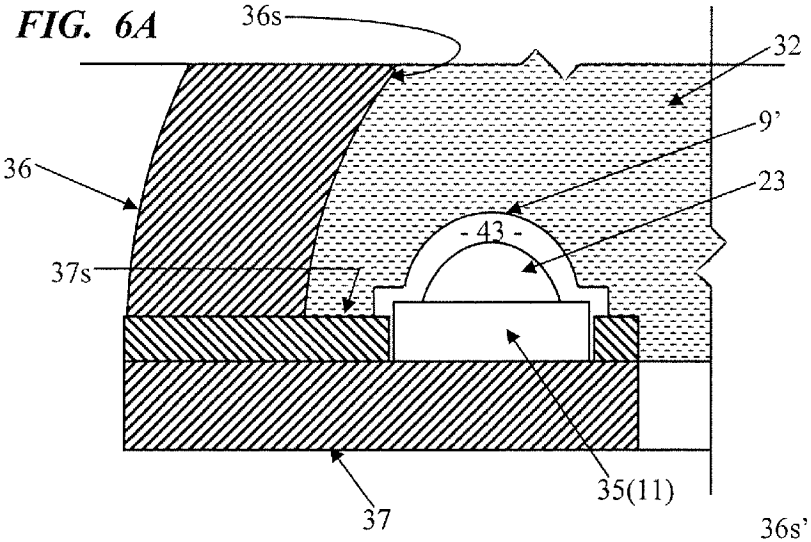
FIG. 6A is an enlarged cross sectional view, showing additional details of a portion of the exemplary fixture of FIG. 4 in the area around one of the LED type solid state light emitters.
Figure 6B:
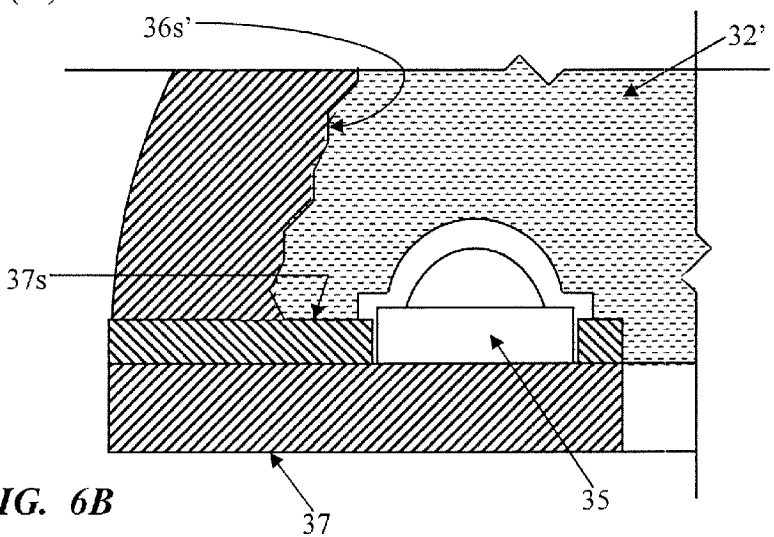
FIG. 6B is an enlarged cross sectional view similar to that of FIG. 6A, but in which there is an irregular texture at the interface between the curved surface of the solid and the adjacent diffusely reflective surface.

FIGS. 6A and 6B are enlarged cross sectional views of a portion of the fixture of FIG. 4. These views are useful in understanding that the surfaces forming the interface between the light transmissive solid and the reflector, of the optical integrating volume, may have a variety of different textures in the various types of fixtures discussed herein. Elements of the fixture of FIG. 4, which appear in the views of FIGS. 6A and 6B are the same as in FIG. 4, and for convenience, detailed discussion of the similar elements is omitted here. FIG. 6A shows that the reflective surface 36*s* has a smooth contour. The outer surface of the light transmissive solid 32 also is relatively smooth, and the two surfaces closely conform to or mate with each other. Although not shown, there may be some minimal gaps between the surfaces. If such minimal gaps do not impair performance (e.g. do not tend to trap light) they may be unfilled. If it is desired to eliminate any such gaps, an optical adhesive or similar material may be used between these two surfaces.

The reflective surface 36*s*' (FIG. 6B) has an irregular roughened contour. The outer surface of the light transmissive solid 32' also is roughened, in a similar manner. Again, the two surfaces closely conform to or mate with each other. The irregular contour may be produced, for example, by bead blasting one surface and molding the other element onto the roughened surface. One approach would be to manufacture the solid 32' in the generally desired shape and then bead blast the relevant portion(s) of the outer surface of the solid. The reflector would then be formed as a coating (e.g. powder coat or paint) on that surface, and the reflective inner surface 36*s* would closely conform to the bead blasted (irregular roughened) surface of the solid 32'. Again, if it is desirable to eliminate any gaps that may exist between the surfaces, an optical adhesive or the like may be used in between the surfaces. Those skilled in the art will recognize that these surfaces may have a variety of other textures, e.g. roughened but exhibiting a regular contour pattern such as a saw tooth, sinusoidal or triangular pattern. Providing a non-smooth or roughened texture surface or surfaces at the interface between the solid and the reflector surface provides additional diffusion.

The enlarged view of FIG. 6A is also useful in illustrating another point, regarding an exemplary way to implement the interfacing of the LED type source to the light transmissive solid. The LED type light source in this example may be similar to the source shown in FIG. 2, and therefore this drawing indicates the LED using both reference numerals 35(11). As shown in FIG. 6A, the light transmissive solid 32 has a light emitter interface region 9', for each LED type solid state light emitter 35(11). On the solid 32, the contour of the interface region 9' will generally follow the contour of the exposed portion of the LED 35(11), including the outer surface of the epoxy dome 23 through which the device 35(11) emits light. However, depending on the techniques used to manufacture the light transmissive solid 32, the light emitter interface region 9' by itself may not perfectly match the exposed portion of the LED 35(11). To illustrate this point, FIG. 6A shows a somewhat enlarged spacing or gap between the LED light source 35(11) and the matching light emitter interface region. To provide the desired conformity and to substantially eliminate any air gap, the coupling between the transmissive solid 32 and the LED 35(11) is provided with an optical adhesive 43 between the surface serving as the interface region 9' on the transmissive solid and the light emitting region of the dome 23 of the LED. The optical adhesive would be relatively transparent and would have an appropriate index of refraction, to insure efficient extraction of light from the epoxy dome 23 of the LED 35(11).

Figure 7:
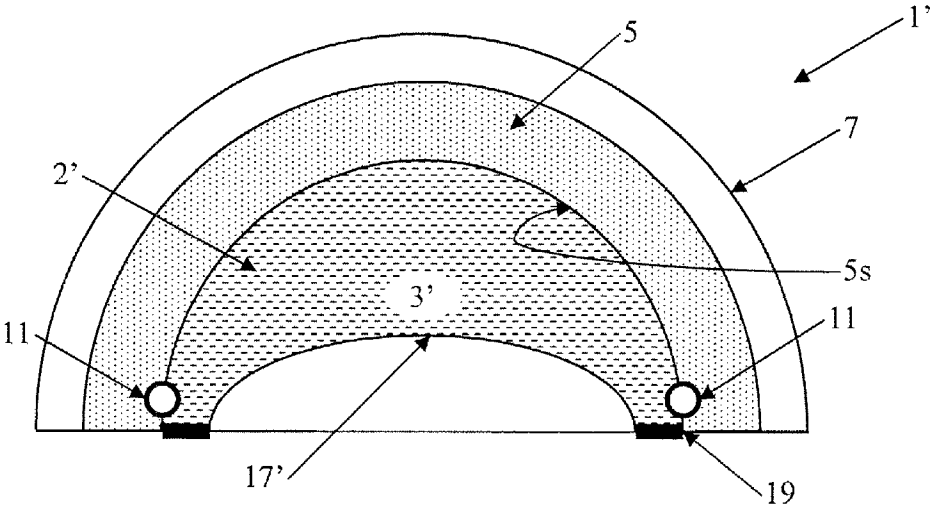
FIG. 7 is a cross section of an example of a light fixture, similar to that of FIG. 1, but in which the exposed portion of the surface of the light transmissive solid is concave in the vicinity of the passage where integrated light emerges from the volume.
Figure 8A:
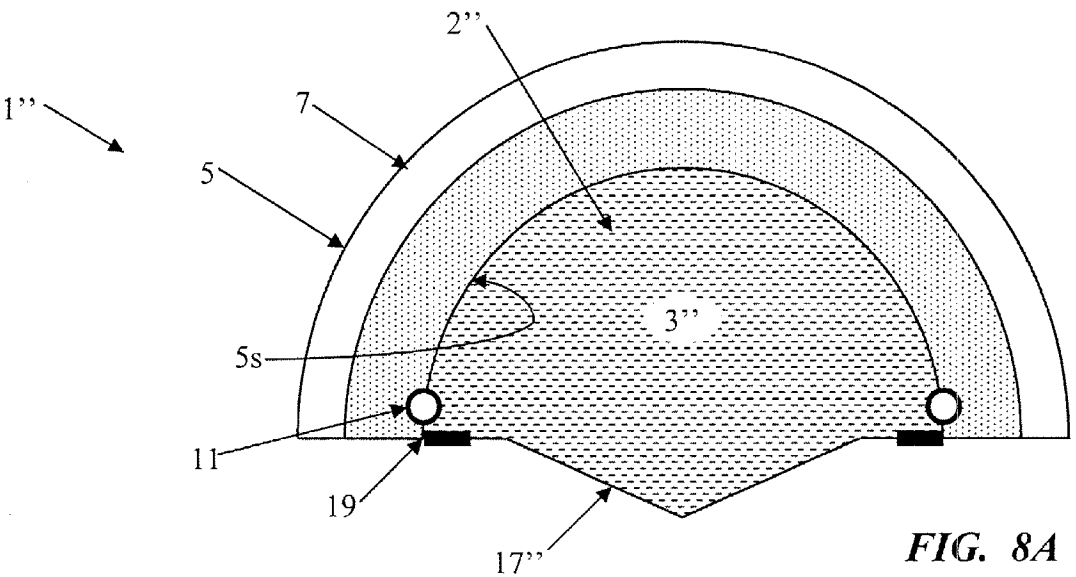
FIG. 8A is a cross section of an example of a light fixture, similar to that of FIG. 1, but in which the exposed portion of the surface of the light transmissive solid extends outward in the vicinity of the passage where integrated light emerges from the volume, to form a cone or prism.
Figure 8B:
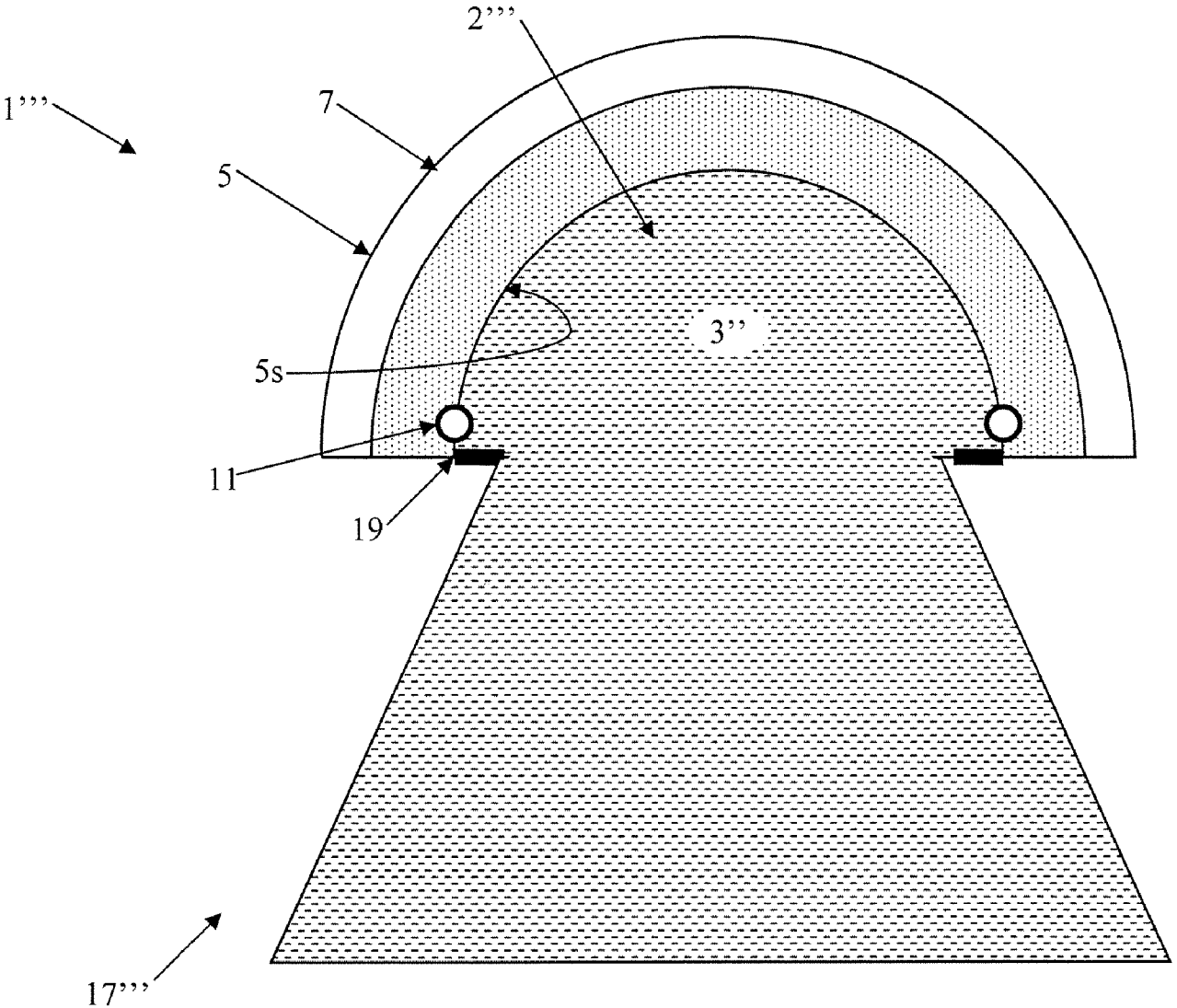
FIG. 8B is a cross section of a fixture similar to that of FIG. 8A, in which the outward extension widens as it extends away from the integrating volume.

FIGS. 7, 8A and 8B are cross sections of examples of light fixtures, similar to that of FIG. 1. In general, the elements of the fixtures in FIGS. 7, 8A and 8B are similar to the elements of the fixture of FIG. 1 and are indicated by the same reference numerals. For convenience, detailed discussion of the similar elements is omitted here, although the reader may wish to reconsider portions of the description of FIG. 1. FIGS. 7, 8A and 8B, however, show that the portion of the surface of the solid that is exposed for light emission may have different shapes, in fixtures generally similar to the design of FIG. 1, much like we discussed earlier relative to the alternative designs of FIGS. 4 and 5.

In the example of FIG. 7, the solid 2' and thus the volume 3' have a somewhat different shape than in the fixture of FIG. 1. In the fixture 1', the light transmissive solid 2' is concave at the passage where integrated light emerges from the optical integrating volume 3'. Hence, the portion 17' of the surface of the solid 2' that is exposed for light emission extends inward in a curved concave shape. Those skilled in the art will recognize that the solid may exhibit a variety of different inwardly extending shapes, such as conical or pyramidal shapes, in the region 17' where light is emitted from the transmissive solid 2'.

In the example of FIG. 8A, the solid 2" and thus the volume 3" have yet another somewhat different shape. In the fixture 1", the portion 17" of the surface of the light transmissive solid 2" that is exposed for light emission extends outward from the optical integrating volume 3". The surface portion 17" illustrated in the drawing has a conical shape, although curved convex shapes, pyramidal shapes or other contours may be used.

The shape in the region 17' or 17" is chosen to distribute the light emitted from the integrating volume in a manner that facilitates the particular lighting application.

FIG. 8B shows a solid 2'" that expands as it extends out from the optical integrating volume 3'". In a hemispherical volume and circular passage example, the extension may have the shape of a truncated cone. However, the extension may have other shapes and/or contours, as discussed above relative to the deflector 41. The side surfaces of the extension may be exposed to allow light emission, or some or all of the side surfaces may be coated with reflective material or materials to serve as a deflector/concentrator similar to the deflector 41. If reflective, the reflectivity/color may be selected for the particular application as discussed above relative to the deflector 41.

Figure 10:
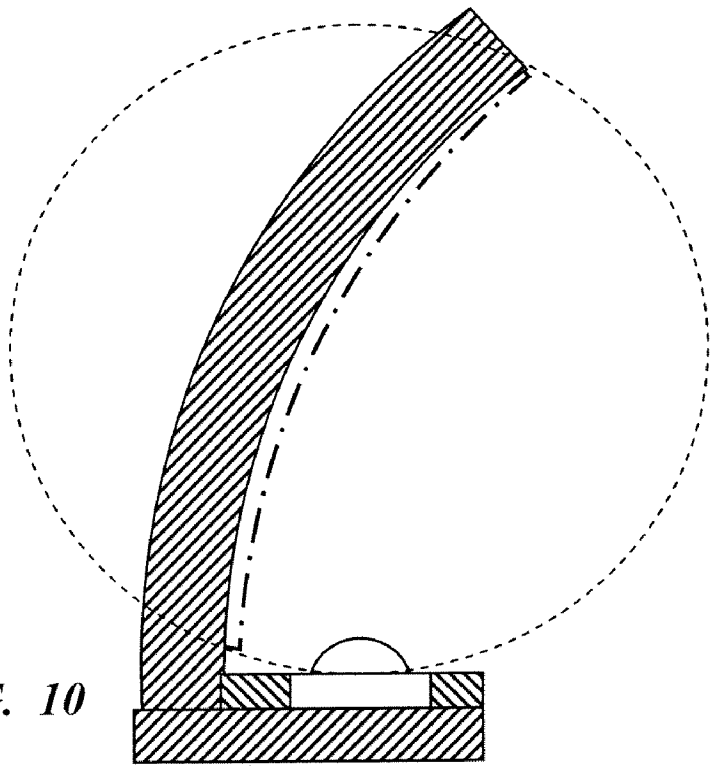
FIG. 10 is an enlarged cross sectional view of a fixture like that of FIG. 4 in the area around one of the LEDs, in which the LED output (ala FIG. 9) is directed toward the dome shaped reflector at the perimeter of the optical integrating volume, and showing the substantially circular distribution of the LED light output and the impact thereof on the reflective inner surface of the dome shaped reflector.
Figure 9:
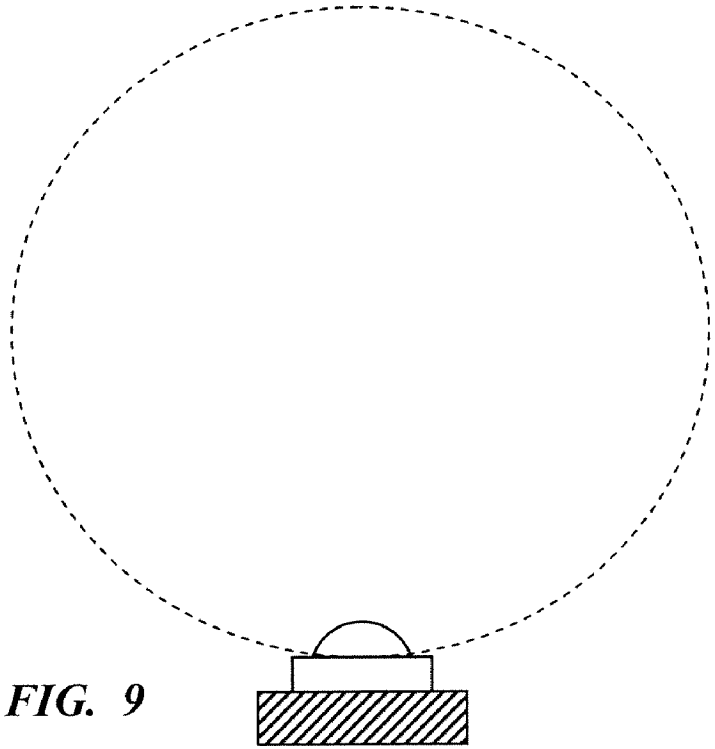
FIG. 9 is an enlarged view of a LED mounted on a circuit board, wherein the LED is of a type exhibiting a substantially circular (e.g. Lambertian) distribution of the light output.
Figure 11:
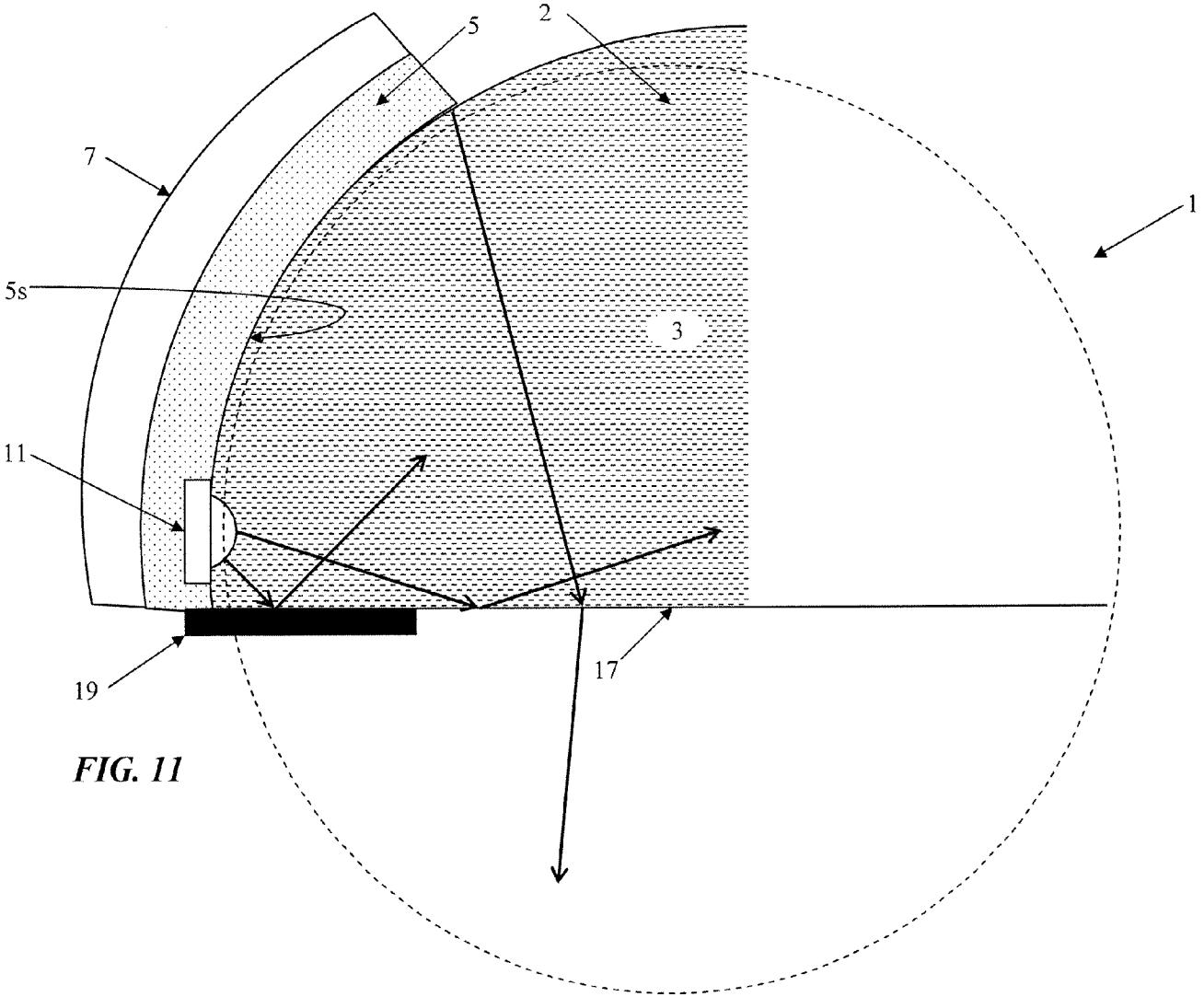
FIG. 11 is an enlarged cross sectional view of a fixture similar to that of FIG. 1 in the area around one of the LEDs, in which the LED is mounted tangentially along a portion of the reflective surface at the perimeter of the optical integrating volume, and showing the substantially circular distribution of the LED light output directed outward into the light transmissive solid and away from any adjacent area of the curved surface of the light transmissive solid and away from the adjacent reflective surface.

FIGS. 9-11 are useful in explaining a distinction between fixtures configured as in the example of FIG. 4 and fixtures configured as in the example of FIG. 1. FIG. 9 is an enlarged view of a LED mounted on a circuit board, such as might be the case of a LED mounted on the board 4 in the fixture of FIG. 4 (see also FIGS. 6A and 6B). For convenience, portions of other elements of the fixture such as the reflective surface on the board, the reflector and the transmissive solid have been omitted from FIG. 9. The LED may be similar to that shown in FIG. 2. Such a solid state light emitter typically exhibits a substantially circular (e.g. Lambertian) type omni-directional output distribution of the light generated by the LED chip(s) within the device, as represented in the drawing by the dotted line circle. This is a fairly common type of output distribution for LED light sources, although not all LEDs exhibit this type of output distribution. In the illustrated orientation, the circular distribution extends upward.

FIG. 10 illustrates a LED and its output distribution similar to those of FIG. 9, but with some additional elements of the fixture, of a type similar to that shown if FIG. 4. Although the solid is still omitted, for convenience, the illustration in FIG. 10 includes a portion of the curved reflector. With the board substantially at right angles to the wall formed by the reflector, the LED is oriented to emit light toward the reflective surface of the dome shaped reflector, upward when the fixture is oriented in the manner illustrated in drawings such as FIGS. 1 and 10. With the omni-directional output distribution, this results in a non-uniform light level impacting the reflector surface at the perimeter of the optical integrating volume. The portion of the LED output distribution shown in dotted line to the left of the reflector wall actually impacts on the region of the reflective surface, shown directly above the LED in the illustrated arrangement. As a result, the region of the reflector surface that is shown above the LED receives an inordinate amount of the output light from the LED, as represented by the dot-dash curve along that surface area in FIG. 10. The increased intensity or amount of LED light impacting the surface in that region may be visible as a bright area or "hot spot" on the reflective surface.

FIG. 11 is an enlarged cross sectional view of a fixture 1 the same as or similar to that of FIG. 1, in the area around one of the LEDs 11, in which the LED is mounted tangentially along a portion of the dome shaped portion of the perimeter of the optical integrating volume 3. For convenience, detailed discussion of the similar elements is omitted here. Of note, the enlarged view in FIG. 11 shows the substantially circular distribution of the LED light output (dotted line circle) directed outward from the LED 11 into the light transmissive solid 2 (the interior of the optical integrating volume 3) and away from any adjacent area of the curved surface of the light transmissive solid 2 and away from the adjacent reflective surface 5*s* of the reflector 5. As discussed earlier and as shown by the reflection arrows in FIG. 11 representing light from the LED 11, the combination of the mask 19 and the total internal reflection along the exposed region 17 of the solid surface substantially prevents any direct emissions from the LED 11 from emerging through the light emission surface of the light transmissive solid 2. The portion of the emission pattern (dotted line circle) that would extend below the mask and solid actually is reflected by the mask and the total internal reflection at the surface region 17 back into the solid 3 for subsequent reflection by the diffusely reflective surface 5*s* of the reflector 5 (see also FIG. 2). However, the orientation of the LED 11 tends to conform the emission pattern (dotted line circle) more closely to the shape of the diffusely reflective interior surface 5*s* of the reflector 5 and thereby avoid bright areas or "hot spots" on the reflective surface 5*s* that might otherwise have been created by other orientations of the LED as was shown in FIG. 10. As discussed earlier relative to FIG. 2, light reflected from higher elevations of the surface 5*s* impacts the exposed surface region 17 at a larger incident angle and passes through, that is to say as part of the virtual source integrated light emission.

The present teachings also encompass a variety of other cavity based light fixture structures or arrangements that can incorporate a light transmissive solid within the optical integrating cavity.

For example, to tailor the output distribution from the light fixture to a particular general lighting application, it is also possible to construct the optical integrating volume so as to provide constructive occlusion. In general, constructive occlusion type lighting systems utilize a light source optically coupled to an active area of the fixture, typically the aperture of a cavity or an effective aperture formed by a reflection of the cavity. This type of fixture utilizes diffusely reflective surfaces, such that the active area exhibits a substantially Lambertian characteristic. A mask occludes a portion of the active area of the fixture, in the following examples, the aperture of the cavity or the effective aperture formed by the cavity reflection, in such a manner as to achieve a desired output performance characteristic for the lighting apparatus with respect to the area or region to be illuminated for the lighting application. In examples of the present fixtures or systems using constructive occlusion, the optical integrating cavity comprises a base, a mask and a cavity formed in the base or the mask. The mask would have a reflective surface facing toward the aperture. The mask is sized and positioned relative to the active area so as to constructively occlude the active area. As with the earlier optics, the constructive occlusion type fixture would also include a light transmissive solid filling at least a substantial portion of the volume that serves as the optical integrating cavity. It may be helpful to consider some examples of fixtures using constructive occlusion.

Figure 12:
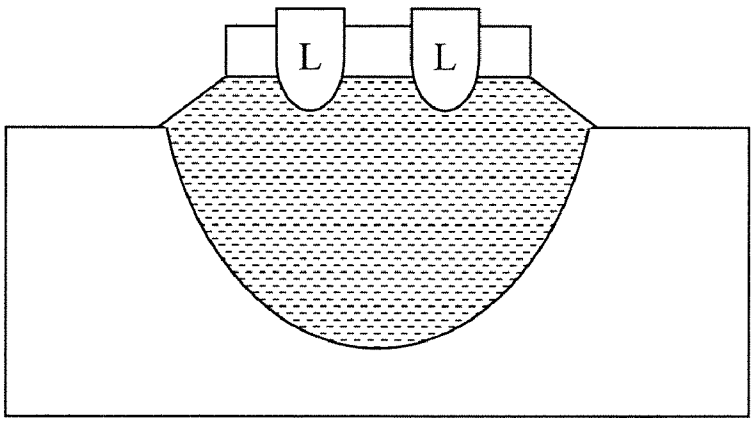
FIG. 12 is a cross section of another light fixture for a general lighting application, which utilizes a mask in combination with a solid filled cavity, configured to implement constructive occlusion.

FIG. 12 shows a general lighting fixture, which utilizes a mask in combination with an optical integrating volume or cavity, configured to implement constructive occlusion, in which the volume between the mask and the surface of the cavity is substantially filled with a light transmissive solid, in a manner similar to the use of the solids in the cavities/volumes in the earlier examples. In this constructive occlusion example, the cavity is formed in the base with the upper perimeter of the cavity forming the constructively occluded aperture. The mask is located outside the cavity with a reflective surface facing toward the aperture of the cavity formed in the base. The solid fills the cavity, and it extends and fills the region between the aperture and the mask surface. The optic will provide an upwardly directed tailored output distribution, in the illustrated orientation, essentially similar to that provided by earlier constructive occlusion type light fixtures, yet will exhibit benefits from use of the solid much like some or all of the other types of fixtures discussed above.

Figure 13A:
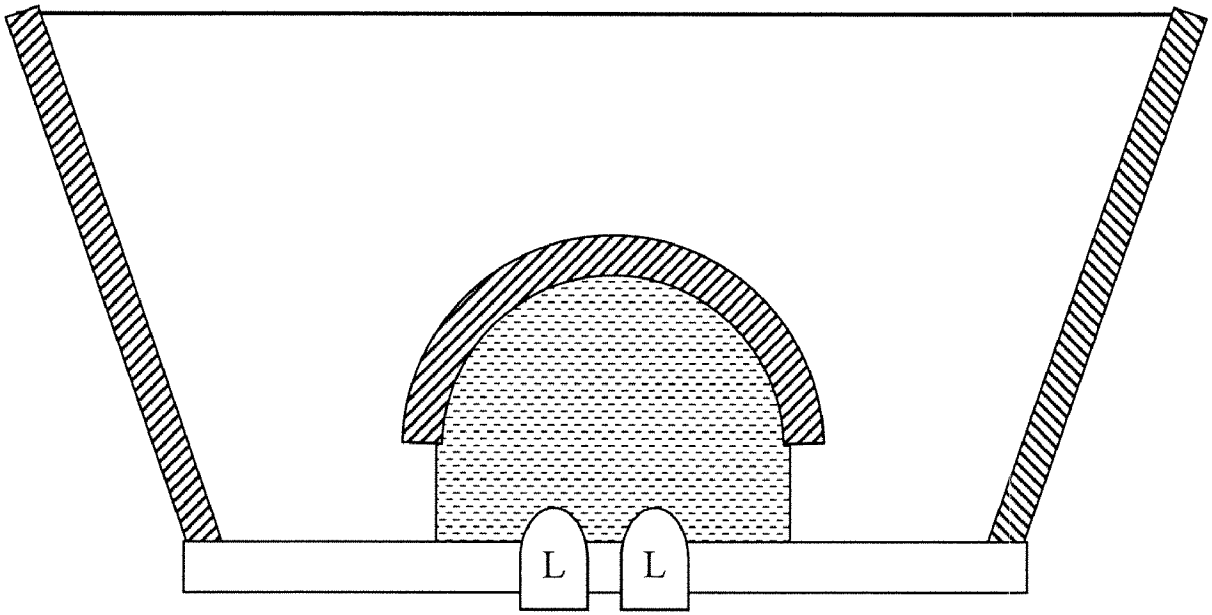
FIG. 13A is a cross section of another constructive occlusion example of a light fixture for a general lighting application, with the optical integrating volume at least partially filled by a light transmissive solid.
Figure 13B:
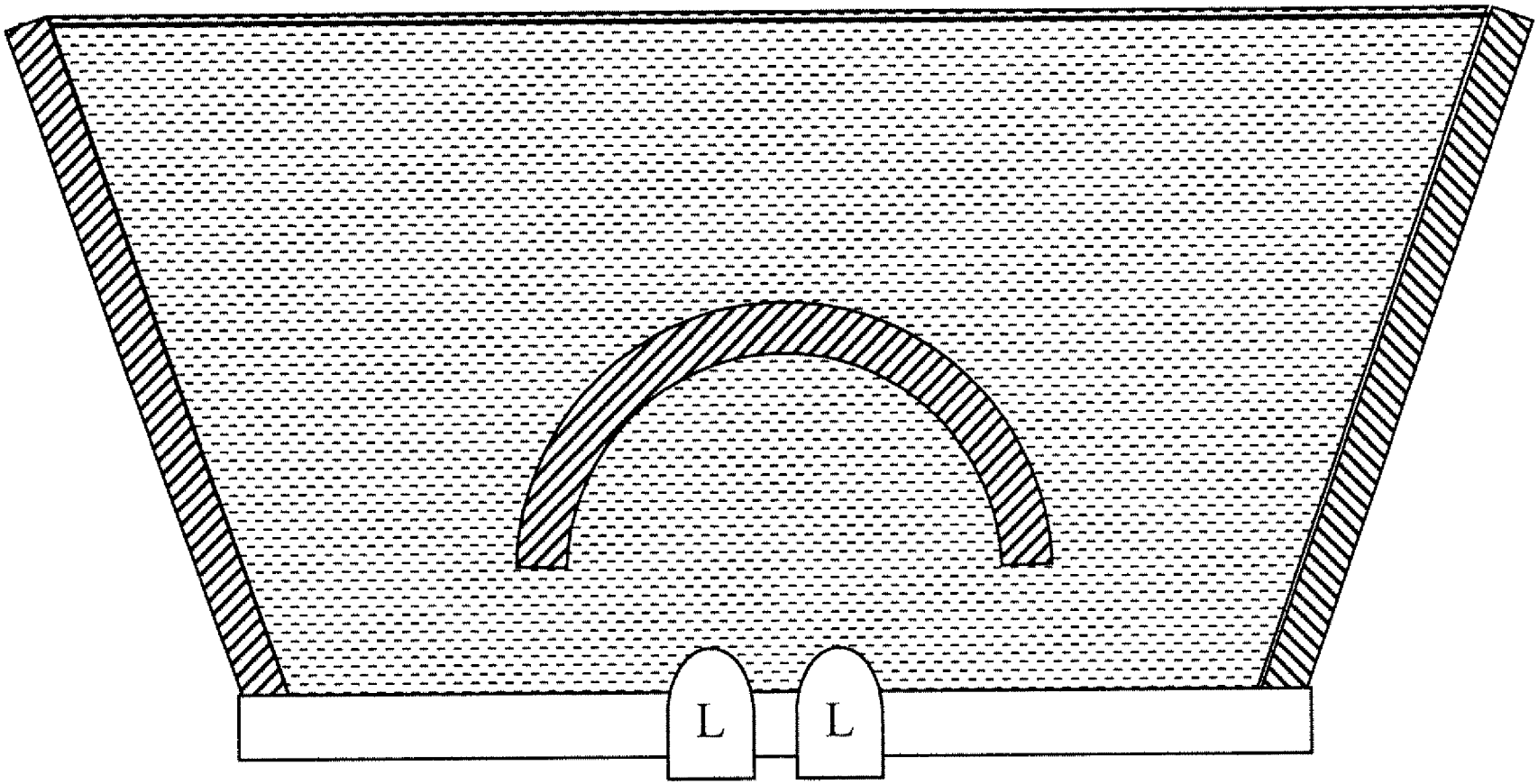
FIG. 13B is a cross section of a fixture similar to that of FIG. 13A, in which the solid also fills the volume of the deflector.

FIGS. 13A and 13B illustrate additional constructive occlusion examples of light fixtures for a general lighting application. In these examples, the surface of the base is flat, and the cavity is formed in the mask. The active optical area of the base is essentially the reflection of the cavity on the surface of the base. In the example of FIG. 13A, the light transmissive solid fills the cavity volume formed in the mask as well as the space between the mask and the base. The fixture also includes a deflector coupled to the active optical area of the base. In the example of FIG. 13B, the solid also fills the volume of the deflector. Again, each such fixture will provide a tailored output distribution, essentially similar that provided by earlier constructive occlusion type light fixtures yet will exhibit benefits from use of the solid much like some of the other types of fixtures discussed above.

More detailed discussions of the light generation, diffuse reflection and constructive occlusion operations of similar light fixtures may be found in previously incorporated US Patent Application Publication No. 2007/0045524 (with respect to FIGS. 11-16 thereof) and the discussion of those similar examples from that Publication are incorporated herein by reference.

Figure 14:
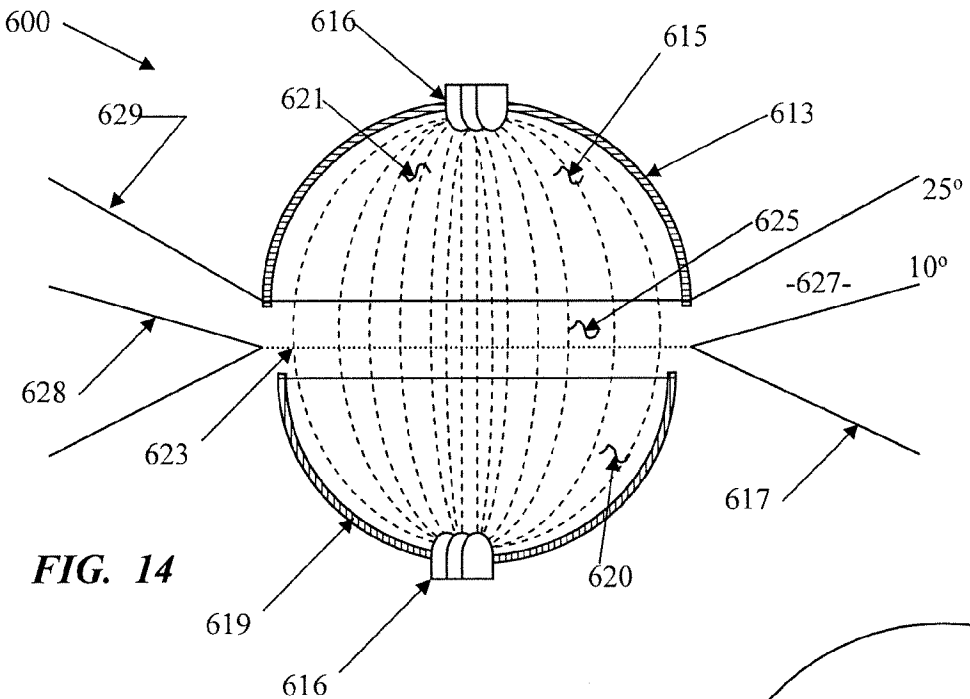
FIG. 14 is a cross section of yet a further constructive occlusion example of a light fixture for a general lighting application, with at least a substantial portion of the optical integrating volume filled by a light transmissive solid.
Figure 15:
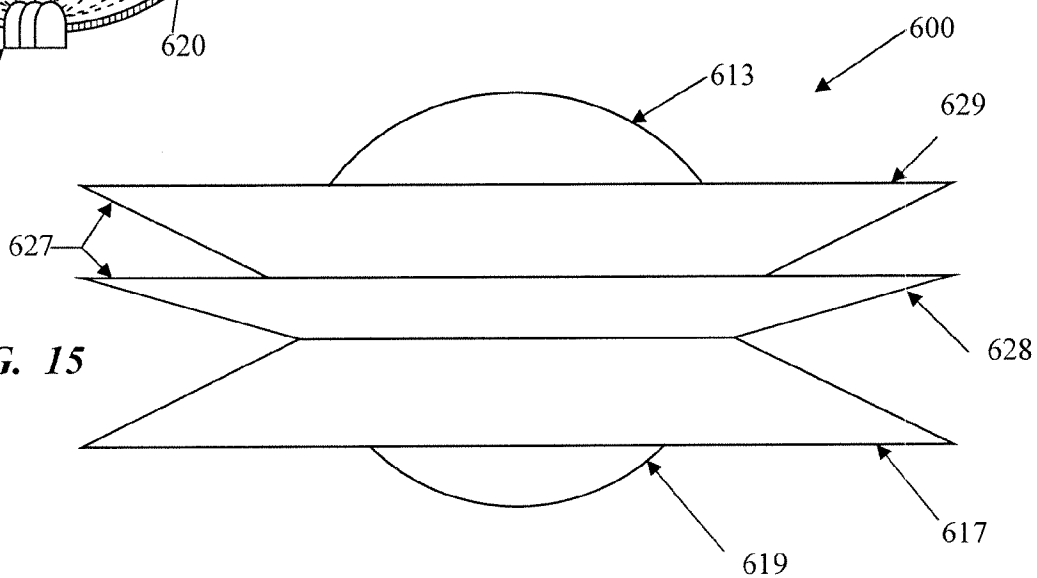
FIG. 15 is a side or elevational view.
Figure 16:
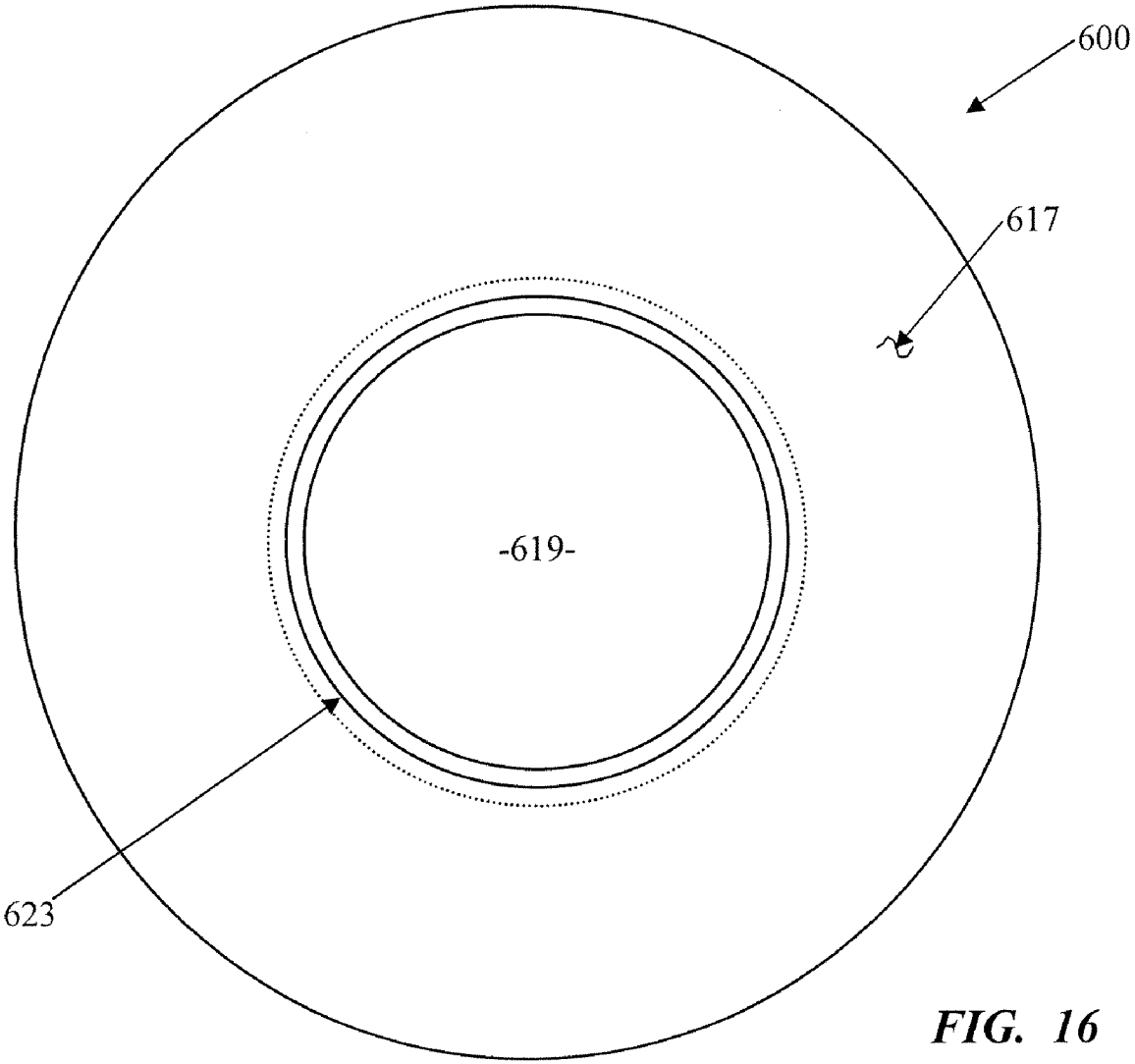
FIG. 16 is a bottom plan view, of the light fixture of FIG. 14.

FIG. 14 illustrates yet a further constructive occlusion example of a light fixture for a general lighting application. FIG. 15 is a side or elevational view, and FIG. 16 is a bottom plan view, of the light fixture of FIG. 14. In that example, the fixture 600 has a ported cavity and a fan shaped deflector, with a constructive occlusion cavity in the base as well as a cavity in the mask, and a light transmissive solid 621 (indicated by curved cross-hatching in the view of FIG. 14) similar to the solids in the earlier examples substantially fills the volume of both cavities as well as the space in-between. This light transmissive solid 621 has a light emitter interface region, for each LED type solid state light emitter 616, which closely conforms to the light emitting region of the solid state light emitter. Curved surfaces of the transmissive solid 621 conform closely to and are in proximity with corresponding curved diffusely reflective interior surfaces of the reflectors forming the two cavities. The port exposes one emission region of the surface of the solid (one effective optical aperture), whereas the gap between the base and the mask expose an additional emission region of the surface of the solid (another effective optical aperture). The deflector coupled to the port of the base cavity may form a "fan" extending along one side or around all or part of the circumference of that cavity. The deflector also expands (up and down in the illustration) as it extends out from the port. Principles of constructive occlusion (diffuse reflectivity in a mask and cavity structure) are combined with the port and deflector structure. The space between the cavity and mask serves as the optical integrating volume since the cavity is at least substantially filled with the light transmissive solid 621. The constructive occlusion provides a tailored intensity distribution for light energy illuminating a first region; whereas the integrating cavity, port and deflector distribute another portion of the light energy over a second field of intended illumination. The first and second areas illuminated may overlap slightly, or one may include the other, but preferably most of the two areas are separate. In some cases such as the example of FIGS. 12-14, the fixture configuration creates a dead zone between the two regions. However, the light transmissive solid 621 provides some or all of the advantages discussed above relative to the earlier examples. A more detailed discussion of various ported cavity and fan type optics utilizing constructive occlusion, including an optic similar to that of FIGS. 14-16 (except for the light transmissive solid and the LED type light sources), may be found in AOT's U.S. Pat. No. 6,286,979, the entire disclosure of which is incorporated herein by reference.

In view of the addition of the port, it may be helpful to consider this constructive occlusion example in somewhat more detail. The fixture 600 comprises two opposing domes 613 and 619 of slightly different diameters supported at a distance from each other. Although other shapes may be used, in the example, each dome is substantially hemispherical. The inner surfaces of the domes 613, 619 are diffusely reflective, as in several of the earlier examples. The upper dome 613 forms the base for constructive occlusion purposes and is slightly larger in horizontal diameter than the lower dome 619. The lower dome 619 forms the mask for constructive occlusion purposes. The inner surface of the upper dome 613 forms a reflective cavity 615, for constructive occlusion purposes, in the shape of a segment of a sphere. The reflective interior 620 of the lower dome 619 could be considered as a cavity or a part of a cavity when combined with 615 (similar to various cavities in the earlier examples), but for purposes of discussion here we will refer to the reflective interior region 620.

Although other solid state light sources could be used, for discussion purposes, the fixture is assumed to use one or more LED type solid state light sources 616 similar to those used in earlier examples. Hence, as shown in FIG. 12, the fixture includes a number of LEDs 616 coupled to each of the domes 613 and 619 so as to supply light into the volume between the reflective domes. As in the earlier examples, the LEDs 616 may be at or coupled to emit light into the interior volume of the fixture 600 from various points on the dome surface(s) and/or oriented so as to supply light in various directions into the interior volume. Mainly, the direct emissions of the LEDs 616 would be directed outward into the volume as discussed above relative to FIG. 11 and to not directly impact any of the exposed surfaces of the light transmissive solid 621 except at sufficiently shallow angles as to provide total internal reflection of the direct LED light emissions from the exposed surfaces. Any number of LEDs 616 may be used to provide the requisite light intensity for a particular general lighting application.

Although other shapes may be used, in the example, the mask 619 takes the form of a second dome forming the reflective region. The fixture 600 may use the dome shaped mask, a smaller or shallower dome or even a flat disk-shaped mask, if the designer elects. The combination of the cavity 615 and the hemispherical reflector region 620, within the two domes 613 and 619, closely approximates a spherical optical integrating cavity.

The fixture 600 also comprises three angled, circular plates 617, 628 and 629 mounted to encircle the two domes 613, 619 as shown. Each angled plate takes the form of a truncated, straight-sided cone. The cone formed by the lower plate 617 has its broad end down in the orientation shown in FIGS. 14 and 15. The cone of the plate 628 has its broad end upward as does the cone of the plate 629. In the example, the sidewall of the cone of the plate 628 has a 10° incline (up from the horizontal in the illustrated orientation); and the sidewall of the cone of the plate 629 has a 25° angle inclination upward relative to the illustrated horizontal.

The lower or inner surface of the plate 617 is reflective and serves as a shoulder formed about the constructive occlusion aperture 623 of the fixture 600. The upper or inner surface of the plate 628 is reflective and serves as one wall of the expanding fan-shaped deflector 627. The lower or inner surface of the plate 629 is reflective and serves as the other wall of the expanding fan-shaped deflector 627. The reflective shoulder surface of the plate 617 preferably is specular, although materials providing a diffuse reflectivity or other type of reflectivity could be used on that surface. At least a substantial portion of each of the reflective surfaces of the deflector 627 has a specular reflectivity. Some sections of those surfaces may have a different reflectivity, such as a diffuse reflectivity, for example, adjacent the outer ends of the surfaces, for certain applications.

The junction between the plates 617 and 628 forms the optical aperture 623 for constructive occlusion purposes. A portion of the surface of the light transmissive solid 621 is exposed in the region between that junction between the plates 617 and 628 (perimeter of the constructive occlusion aperture 623) and the adjacent edge or perimeter of the mask 619. The exposed portion of the solid surface in this region permits emission of integrated light from within the volume of the light transmissive solid 621, albeit as processed by the constructive occlusion aspects of the fixture 600.

The space between the junction between the plates 617 and 628 and the lower edge of the plate 629 forms an annular port 625 formed in the wall of the base 613 to provide optical coupling of the cavity 615 to the deflector 627. The port 625 exposes another portion of the surface of the light transmissive solid 621 for light emission of integrated light from within the volume of the light transmissive solid 621. Although generally referred to herein as a "port" to distinguish from the constructive occlusion aperture 623, the port 625 does expose a portion of the surface of the solid to create another effective optical aperture for light emission from the fixture. In this embodiment, annular port 625 and the corresponding exposed region of the solid are adjacent to the aperture 623. This position for the port may be preferred, for ease of construction, but the annular port could be at any elevation on the dome forming the base 613 and cavity 615, to facilitate illumination of a second field or region at a particular angular range relative to the light fixture 600 with integrated light from the cavity 615.

In this ported cavity and fan type constructive occlusion example, the port 625 is formed along the boundary between the edge of the cavity 615 and the shoulder 617. Consequently, the inner edge of the shoulder 617 actually defines the aperture 623 for constructive occlusion purposes with respect to the first region intended for illumination by the fixture 600. The aperture 623 is said to be the aperture of the base-cavity 615 and define the active optical area of the base 613 essentially as if the sides of the cavity 615 extended to the edges of the shoulder 617 (without the port).

Hence the cavity 615, the aperture 623, the mask 619 and the shoulder 617 provide constructive occlusion processing of a first portion of the light from the LEDs 616 for emission from the portion of the light transmissive solid exposed between the junction between the plates 617 and 628 (perimeter of the optical aperture 623) and the adjacent edge or perimeter of the mask 619. The light emitted as a result of such constructive occlusion processing provides a tailored intensity distribution for illumination of a first region, which is below the fixture 600 in the orientation shown in FIGS. 14 and 15. The relative dimensions of the aperture and mask, the distance of the mask from the aperture and size and angle of shoulder 617 determine the intensity distribution in this region, as discussed in the U.S. Pat. No. 6,286,979.

With respect to the port 625, the diffusely reflective surfaces 615 and 620 inside the two domes 613 and 619 together approximate an optically integrating sphere. The integrating sphere processes light from the LEDs 616 and provides an efficient coupling of some of that light for emission from the exposed portion of the surface of the light transmissive solid 621 through the port 625. As with light emitted through the aperture 623, light emitted through the port 625 and deflector 627 includes light integrated from the light generated by the LED type light sources 616.

The fan-shaped deflector 627 directs light emerging through the port 625 upward, away from the first (downward) field of intended illumination. In the illustrated example, the plates 628 and 629 form a limited second field of view, for angles roughly between 10° and 25° above the horizontal in this example. When measured with respect to the downward illumination axis of the fixture 600 as is used in lighting industry standards, this second field of illumination encompasses angles between 100° and 115°. Although some light passing through the port 625 is still directed outside the field of view defined by the deflector walls 628, 629, the reflective surfaces of the deflector 627 do channel most of the light from the port 625 into the area between the angles formed by those walls. As a result, the maximum intensity in the second illuminated region is between the angles defining the field of view of the deflector 627.

In this example, the fan-shaped deflector structure is angled so as to direct light away from the field illuminated by constructive occlusion. The two illuminated regions do not overlap at all. The plates 617 and 628 create a dead zone of no illumination between the two regions.

In an under canopy type lighting application, for example, the fixture 600 is mounted or hung under a canopy. The mounting may place the upper edge of the upper angled plate 629 of the deflector 627 at the surface of the underside of the canopy or a few inches below that surface. The apparatus 600 emits approximately 60% of the light energy output upward, via the port 625 and the fan-shaped deflector structure 627. The fixture 600 emits approximately 40% of the light output downward, as processed by constructive occlusion. The emissions upward are separated from the downward emissions by a dead zone around the horizontal in the orientation illustrated in FIGS. 14 and 15. The dead zone prevents direct illumination of adjacent areas, for example on a nearby highway or in a house next-door to a gas station that has the canopy and the under-canopy light fixture.

Because of the structure of the fixture 600, the light that otherwise would emerge undesirably in the dead zone is kept within the optic and reprocessed by the reflective surfaces, until it emerges into one or the other of the two desired fields of illumination. The fixture 600 therefore provides the desired lighting performance with a particularly high degree of efficiency.

The lighting fixture structure illustrated in FIGS. 14-16 is round and symmetrical about a vertical system axis. For other applications, the design could be made rectangular or even linearized.

A system will typically include a lighting apparatus in the form of a fixture including the solid state light sources, an assembly forming the optical integrating volume and possibly one or more further optical processing elements represented by way of example as a deflector in several of the earlier examples. As discussed herein, the assembly forming the optical integrating volume includes a light transmissive solid and an associated diffuse reflector, essentially forming a solid filled optical integrating cavity. Such a system also includes electronic circuitry to drive and/or control operation of the solid state light sources and thus to operate the light of the fixture. Those skilled in the art will be familiar with a variety of different types of circuits that may be used to drive the solid state light sources. However, it may be helpful to some readers to consider a specific example is some detail.

Figure 17:
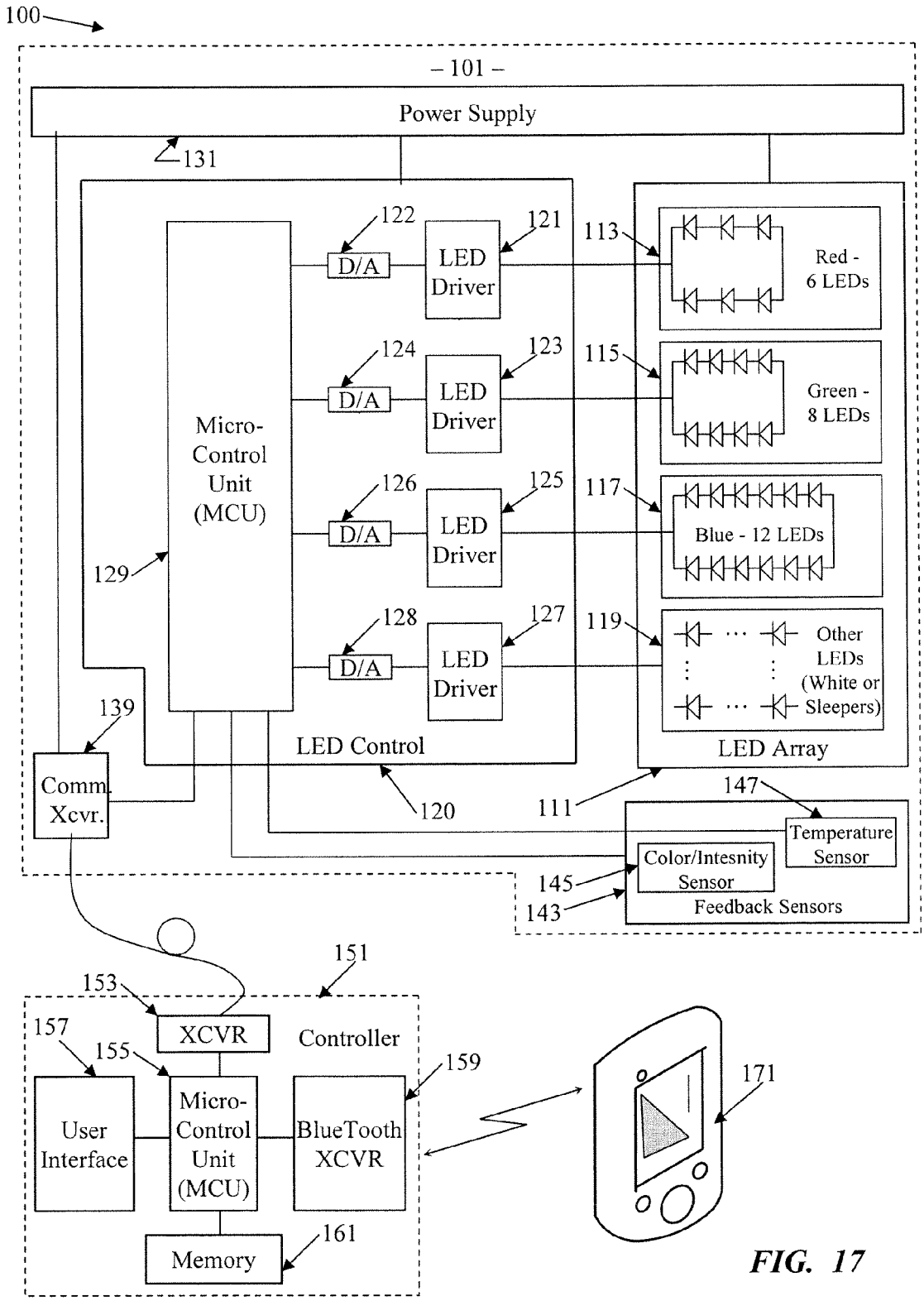
FIG. 17 is a functional block diagram of electronics that may be used in any LED type implementation of any of the fixtures, to produce the desired illumination for the general lighting application.

FIG. 17 is a block diagram of an exemplary solid state lighting system 100, including the control circuitry and the LED type sold state light sources utilized as a light engine 101 in the fixture or lighting apparatus of such a system. Those skilled in the art will recognize that the system 100 may include a number of the solid state light engines 101. The light engine(s) could be incorporated into a fixture in any of the examples discussed above.

The circuitry of FIG. 17 provides digital programmable control of the light. Those skilled in the art will recognize that simpler electronics may be used for some fixture configurations, for example, an all white LED fixture may have only a power supply.

In the light engine 101 of FIG. 17, the set of solid state sources of light takes the form of a LED array 111. Although other combinations of two or more color LEDs are within the scope of the present teachings, for purposes of discussion of the exemplary circuitry, we will assume that the array includes at least three primary color LED type solid state sources. Hence, the exemplary array 111 comprises two or more LEDs of each of three primary colors red (R), green (G) and blue (B), represented by LED blocks 113, 115 and 117, respectively. For example, the array 111 may comprise six Red LEDs 113, eight Green LEDs 115 and twelve Blue LEDs 117, although other primary colors may be used (e.g. cyan, magenta and yellow).

The LED array 111 in this example also includes a number of additional or "other" LEDs 119. There are several types of additional LEDs that are of particular interest in the present discussion. One type of additional LED provides one or more additional wavelengths of radiant energy for integration within the volume or cavity. The additional wavelengths may be in the visible portion of the light spectrum, to allow a greater degree of color adjustment of the virtual source light output. Alternatively, the additional wavelength LEDs may provide energy in one or more wavelengths outside the visible spectrum, for example, in the infrared (IR) range or the ultraviolet (UV) range. UV light for example might be used to pump phosphors or quantum dots within the fixture.

The second type of additional LED that may be included in the system 100 is a sleeper LED. Some LEDs initially would be active, whereas the sleepers would be inactive, at least during initial operation. Using the circuitry of FIG. 17 as an example, the Red LEDs 113, Green LEDs 115 and Blue LEDs 117 might normally be active. The LEDs 119 would be sleeper LEDs, typically including one or more LEDs of each color used in the particular system, which can be activated on an "as-needed" basis, e.g. to compensate for declining performance of corresponding color LEDs 113, 115 or 117.

The third type of other LED of interest is a white LED. The entire array 111 may consist of white LEDs of one, two or more color temperatures. There may be a combination of white LEDs and LEDs of one single wavelength chosen to correct the color temperature of the light form the white LEDs, e.g. yellow or red LEDs to compensate for the somewhat bluish temperature of most types of white LEDs. For white lighting applications using primary color LEDs (e.g. RGB LEDs as shown), one or more additional white LEDs provide increased intensity; and the primary color LEDs then provide light for color adjustment and/or correction.

The electrical components shown in FIG. 17 also include a LED control system 120 as part of the light engine 101. The system 120 includes driver circuits 121 to 127 for the various LEDs 113 to 119, associated digital to analog (D/A) converters 122 to 128 and a programmable micro-control unit (MCU) 129. The driver circuits 121 to 127 supply electrical current to the respective LEDs 113 to 119 to cause the LEDs to emit visible light or other light energy (e.g. IR or UV). Each of the driver circuits may be implemented by a switched power regulator (e.g. Buck converter), where the regulated output is controlled by the appropriate signal from a respective D/A converter. The driver circuit 121 drives the Red LEDs 113, the driver circuit 123 drives the Green LEDs 115, and the driver circuit 125 drives the Blue LEDs 117. In a similar fashion, when active, the driver circuit 127 provides electrical current to the other LEDs 119. If the other LEDs provide another color of light, and are connected in series, there may be a single driver circuit 127. If the LEDs are sleepers, it may be desirable to provide a separate driver circuit 127 for each of the LEDs 119 or at least for each set of LEDs of a different color.

The driver circuits supply electrical current at the respective levels for the individual sets of LEDs 113-119 to cause the LEDs to emit light. The MCU 129 controls the LED driver circuit 121 via the D/A converter 122, and the MCU 129 controls the LED driver circuit 123 via the D/A converter 124. Similarly, the MCU 129 controls the LED driver circuit 125 via the D/A converter 126. The amount of the emitted light of a given LED set is related to the level of current supplied by the respective driver circuit, as set by the MCU 129 through the respective D/A converter.

In a similar fashion, the MCU 129 controls the LED driver circuit 127 via the D/A converter 128. When active, the driver circuit 127 provides electrical current to the other LEDs 119. If the LEDs are sleepers, it may be desirable to provide a separate driver circuit and A/D converter pair, for each of the LEDs 119 or for other sets of LEDs of the individual primary colors.

In operation, one of the D/A converters receives a command for a particular level, from the MCU 129. In response, the converter generates a corresponding analog control signal, which causes the associated LED driver circuit to generate a corresponding power level to drive the particular string of LEDs. The LEDs of the string in turn output light of a corresponding intensity. The D/A converter will continue to output the particular analog level, to set the LED intensity in accord with the last command from the MCU 129, until the MCU 129 issues a new command to the particular D/A converter.

The control circuit could modulate outputs of the LEDs by modulating the respective drive signals. In the example, the intensity of the emitted light of a given LED is proportional to the level of current supplied by the respective driver circuit. The current output of each driver circuit is controlled by the higher level logic of the system. In this digital control example, that logic is implemented by the programmable MCU 129, although those skilled in the art will recognize that the logic could take other forms, such as discrete logic components, an application specific integrated circuit (ASIC), etc.

The LED driver circuits and the MCU 129 receive power from a power supply 131, which is connected to an appropriate power source (not separately shown). For most general lighting applications, the power source will be an AC line current source, however, some applications may utilize DC power from a battery or the like. The power supply 131 converts the voltage and current from the source to the levels needed by the driver circuits 121-127 and the MCU 129.

A programmable microcontroller, such as the MCU 129, typically comprises a programmable processor and includes or has coupled thereto random-access memory (RAM) for storing data and read-only memory (ROM) and/or electrically erasable read only memory (EEROM) for storing control programming and any pre-defined operational parameters, such as pre-established light 'recipes' or dynamic color variation 'routines.' The MCU 129 itself comprises registers and other components for implementing a central processing unit (CPU) and possibly an associated arithmetic logic unit. The CPU implements the program to process data in the desired manner and thereby generates desired control outputs to cause the system to generate a virtual source of a desired output characteristic.

The MCU 129 is programmed to control the LED driver circuits 121-127 to set the individual output intensities of the LEDs to desired levels in response to predefined commands, so that the combined light emitted from the optical aperture or passage of the integrating volume has a desired spectral characteristic and a desired spectral characteristic and overall intensity. Although other algorithms may be implemented by programming the MCU 129, in a variable color lighting example, the MCU 129 receives commands representing appropriate RGB intensity settings and converts those to appropriate driver settings for the respective groups 113 to 119 of the LEDs in the array 111.

The electrical components may also include one or more feedback sensors 143, to provide system performance measurements as feedback signals to the control logic, implemented in this example by the MCU 129. A variety of different sensors may be used, alone or in combination, for different applications. In the illustrated examples, the set 143 of feedback sensors includes a color and intensity sensor 145 and a temperature sensor 147. Although not shown, other sensors, such as a separate overall intensity sensor may be used. The sensors are positioned in or around the fixture to measure the appropriate physical condition, e.g. temperature, color, intensity, etc.

The sensor 145, for example, is coupled to detect color distribution in the integrated light energy. The sensor 145 may be coupled to sense energy within the optical integrating volume, within the deflector (if provided) or at a point in the field illuminated by the particular system. Various examples of appropriate color sensors are known. For example, the sensor 145 may be a digital compatible sensor, of the type sold by TAOS, Inc. Another suitable sensor might use the quadrant light detector disclosed in U.S. Pat. No. 5,877,490, with appropriate color separation on the various light detector elements (see U.S. Pat. No. 5,914,487 for discussion of the color analysis).

The associated logic circuitry, responsive to the detected color distribution, controls the output intensity of the various LEDs, so as to provide a desired color distribution in the integrated light energy, in accord with appropriate settings. In an example using sleeper LEDs, the logic circuitry also is responsive to the detected color distribution and/or overall intensity to selectively activate the inactive light emitting diodes as needed, to maintain the desired color distribution in integrated light energy at a desired intensity. The sensor 145 measures the color of the integrated light energy and possibly overall intensity of the light produced by the system and provides measurement signals to the MCU 129. If using the TAOS, Inc. color sensor, for example, the signal is a digital signal derived from a color to frequency conversion, wherein the pulse frequency corresponds to measured intensity. The TAOS sensor is responsive to instructions from the MCU 129 to selectively measure overall intensity, Red intensity, Green intensity and Blue intensity.

The temperature sensor 147 may be a simple thermo-electric transducer with an associated analog to digital converter, or a variety of other temperature detectors may be used. The temperature sensor is positioned on or inside of the fixture, typically at a point that is near the LEDs or other sources that produce most of the system heat. The temperature sensor 147 provides a signal representing the measured temperature to the MCU 129. The system logic, here implemented by the MCU 129, can adjust intensity of one or more of the LEDs in response to the sensed temperature, e.g. to reduce intensity of the source outputs to compensate for temperature increases. The program of the MCU 129, however, would typically manipulate the intensities of the various LEDs so as to maintain the desired color balance between the various wavelengths of light used in the system, even though it may vary the overall intensity with temperature. For example, if temperature is increasing due to increased drive current to the active LEDs (with increased age or heat), the controller may deactivate one or more of those LEDs and activate a corresponding number of the sleepers, since the newly activated sleeper(s) will provide similar output in response to lower current and thus produce less heat.

In a typical general lighting application in say an architectural setting, the fixture and associated solid state light engine 101 will be mounted or otherwise installed at a location of desired illumination. The light engine 101, however, will be activated and controlled by a controller 151, which may be at a separate location. For example, if the fixture containing the light engine 101 is installed in the ceiling of a room as a downlight for task or area illumination, the controller 151 might be mounted in a wall box near a door into the room, much like the mounting of a conventional ON-OFF wall switch for an incandescent or fluorescent light fixture. Those skilled in the art will recognize that the controller 151 may be mounted in close proximity to or integrated into the light engine 101. In some cases, the controller 151 may be at a substantial distance from the light engine. It is also conceivable that the separate controller 151 may be eliminated and the functionality implemented by a user interface on the light engine in combination with further programming of the MCU 129.

The circuitry of the light engine 101 includes a wired communication interface or transceiver 139 that enables communications to and/or from a transceiver 153, which provides communications with the micro-control unit (MCU) 155 in the controller 151. Typically, the controller will include one or more input and/or output elements for implementing a user interface 157. The user interface 157 may be as simple as a rotary switch or a set of pushbuttons. As another example, the controller 151 may also include a wireless transceiver, in this case, in the form of a Bluetooth transceiver 159. A number of light engines 101 of the type shown may connect over common wiring, so that one controller 151 through its transceiver 153 can provide instructions via interfaces 139 to the MCUs 129 in several such light engines, thereby providing common control of a number of light fixtures.

A programmable microcontroller, such as the MCU 155, typically comprises a programmable processor and includes or has coupled thereto random-access memory (RAM) for storing data and read-only memory (ROM) and/or electrically erasable read only memory (EEROM) for storing control programming and any pre-defined operational parameters, such as pre-established light 'recipes' or dynamic color variation 'routines.' In the example, the controller 151 is shown as having a memory 161, which will store programming and control data. The MCU 155 itself comprises registers and other components for implementing a central processing unit (CPU) and possibly an associated arithmetic logic unit. The CPU implements the program to process data in the desired manner and thereby generates desired control outputs to cause the controller 151 to generate commands to one or more light engines to provide general lighting operations of the one or more controlled light fixtures.

The MCU 155 may be programmed to essentially establish and maintain or preset a desired 'recipe' or mixture of the available wavelengths provided by the LEDs used in the particular system, to provide a desired intensity and/or spectral setting. For each such recipe, the MCU 155 will cause the transceiver 139 to send the appropriate command to the MCU 129 in the one or more light engines 101 under its control. Each fixture that receives such an instruction will implement the indicated setting and maintain the setting until instructed to change to a new setting. For some applications, the MCU 155 may work through a number of settings over a period of time in a manner defined by a dynamic routine. Data for such recipes or routines may be stored in the memory 161.

As noted, the controller 151 includes a Bluetooth type wireless transceiver 159 coupled to the MCU 155. The transceiver 159 supports two-way data communication in accord with the standard Bluetooth protocol. For purposes of the present discussion, this wireless communication link facilitates data communication with a personal digital assistant (PDA) 171. The PDA 171 is programmed to provide user input, programming and attendant program control of the system 100.

For example, preset color and intensity settings may be chosen from the PDA 171 and downloaded into the memory 161 in the controller 151. If a single preset is stored, the controller 151 will cause the light engine 101 to provide the corresponding light output, until the preset is rewritten in the memory. If a number of presets are stored in the memory 161 in the controller 151, the user interface 157 enables subsequent selection of one of the preset recipes for current illumination. The PDA also provides a mechanism to allow downloading of setting data for one or more lighting sequences to the controller memory.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A lighting apparatus comprising:

one or more solid state light emitters, the one or more solid state light emitters producing light intensity sufficient for a general lighting application in a region or area intended to be occupied by a person;

an optical integrating volume, outside an enclosure of the one or more solid state light emitters, for receiving and optically integrating light from the one or more solid state light emitters and for emission of integrated light in a direction to facilitate said general lighting application; and a light transmissive solid, having:

a) a light emitter interface region for each solid state light emitter closely conforming to the light emitting region of each solid state light emitter, b) a surface conforming closely to and in proximity with a diffusely reflective interior surface of the optical integrating volume, and c) a light emission surface at least a portion of which forms a transmissive optical passage for emission of integrated light from the optical integrating volume in a direction to facilitate said general lighting application in the region or area.

2. The lighting apparatus of claim 1, further comprising:

a reflector having a diffusely reflective interior surface defining a substantial portion of a perimeter of the optical integrating volume; and a mask having a reflective surface covering another portion of the light emission surface of the light transmissive solid in proximity to the solid state light emitters, wherein the light transmissive solid fills at least a substantial portion of the optical integrating volume.

3. The lighting apparatus of claim 2, further comprising an optical adhesive for coupling each light emitter interface region of the light transmissive solid to a respective solid state light emitter.

4. The lighting apparatus of claim 2, wherein:

each of the one or more solid state light emitters is mounted tangentially with respect to the closely conforming surface of the light transmissive solid such that omni-directional emissions of each emitter extend substantially outward into the light transmissive solid and away from any adjacent area of the closely conforming surface of the light transmissive solid, and the light emission surface of the light transmissive solid reflects a portion of direct emissions from each of the one or more solid state light emitters back into the optical integrating volume by total internal reflection.

5. The lighting apparatus of claim 4, further comprising:

a mask having a reflective surface covering another portion of the light emission surface of the light transmissive solid in proximity to the solid state light emitters; and the mask and the total internal reflection substantially prevent any direct emissions from the one or more solid state light emitters from emerging through the light emission surface of the light transmissive solid into said region or area.

6. The lighting apparatus of claim 4, wherein the light transmissive solid has an index of refraction higher than an index of refraction of an ambient environment in the region or area, to facilitate total internal reflection at the light emission surface of the light transmissive solid.

7. The lighting apparatus of claim 2, further comprising:

a support having an inner surface, wherein:

the reflector comprises granular poly tetrafluoroethylene (PTFE), and the granular PTFE is pressed in-between the conforming surface of the light transmissive solid and the inner surface of the support.

8. The lighting apparatus of claim 1, wherein the light emission surface of the solid is convex in the portion which forms the transmissive optical passage.

9. The lighting apparatus of claim 1, wherein the light emission surface of the solid is concave in the portion which forms the transmissive optical passage.

10. The lighting apparatus of claim 1, wherein the light transmissive solid is at least substantially transparent.

11. The lighting apparatus of claim 1, wherein the light transmissive solid is at least translucent.

12. The lighting apparatus of claim 2, further comprising:

a deflector having a reflective interior surface coupled to the optical passage for concentrating light emitted from the optical passage over a field to be illuminated by the lighting apparatus.

13. The lighting apparatus of claim 1, further comprising:

a mask positioned outside the optical integrating volume and having a reflective surface facing the transmissive optical passage for constructively occluding the transmissive optical passage with respect to a field to be illuminated by the lighting apparatus.

14. The lighting apparatus of claim 12, wherein the reflector has a port adjacent a further portion of a surface of the light transmissive solid such that the further portion also emits integrated light from within the volume, through the port.

15. The lighting apparatus of claim 14, further comprising:

a deflector having a reflective interior surface coupled to the port for directing light emitted through the port over a field to be illuminated by the lighting apparatus.

16. The lighting apparatus of claim 1, in combination with circuitry for controlling operation of the one or more solid state light emitters.

17. The lighting apparatus of claim 1, wherein:

each of the one or more solid state light emitters has a high index of refraction in the vicinity of its light emitting region; and the light transmissive solid has an index of refraction higher than an index of refraction of an ambient environment in the region or area.

18. A lighting fixture comprising:

one or more solid state light emitters, the one or more solid state light emitters producing light intensity sufficient for a general lighting application;

an optical integrating volume, outside an enclosure of the one or more solid state light emitters, for receiving and optically integrating light from the one or more solid state light emitters and for emission of integrated light in a direction to facilitate said general lighting application; and a light transmissive solid at least substantially filling the optical integrating volume.

19. The lighting fixture of claim 18, wherein the light transmissive solid further comprises:

a) a light emitter interface region for each solid state light emitter closely conforming to the light emitting region of each solid state light emitter, b) a surface conforming closely to and in proximity with the diffusely reflective interior surface of the reflector, and c) a light emission surface at least a portion of which forms a transmissive optical passage for emission of integrated light from the optical integrating volume in a direction to facilitate said general lighting application.

20. The lighting apparatus of claim 18, wherein the assembly further comprises:

a reflector having a diffusely reflective interior surface defining a substantial portion of a perimeter of the optical integrating volume.

* * * * *